US011024240B2

(12) United States Patent
Zhu et al.

(10) Patent No.: US 11,024,240 B2
(45) Date of Patent: Jun. 1, 2021

(54) LIQUID CRYSTAL DISPLAY APPARATUS AND LIQUID CRYSTAL DISPLAY CONTROL METHOD FOR IMAGE CORRECTION

(71) Applicant: SONY CORPORATION, Tokyo (JP)

(72) Inventors: Yiwen Zhu, Kanagawa (JP); Kazunori Kamio, Kanagawa (JP); Takahiro Nagano, Kanagawa (JP)

(73) Assignee: SONY CORPORATION, Tokyo (JP)

( * ) Notice: Subject to any disclaimer, the term of this patent is extended or adjusted under 35 U.S.C. 154(b) by 243 days.

(21) Appl. No.: 16/087,886

(22) PCT Filed: Feb. 27, 2017

(86) PCT No.: PCT/JP2017/007464
§ 371 (c)(1),
(2) Date: Sep. 24, 2018

(87) PCT Pub. No.: WO2017/169436
PCT Pub. Date: Oct. 5, 2017

(65) Prior Publication Data

US 2020/0302881 A1 Sep. 24, 2020

(30) Foreign Application Priority Data

Mar. 29, 2016 (JP) ..... JP2016-065533

(51) Int. Cl.
*G09G 3/36* (2006.01)

(52) U.S. Cl.
CPC ..... *G09G 3/36* (2013.01); *G09G 2320/0247* (2013.01); *G09G 2320/0261* (2013.01); *G09G 2320/103* (2013.01); *G09G 2320/106* (2013.01)

(58) Field of Classification Search
CPC ..... G09G 3/36; G09G 2320/0247; G09G 2320/0261; G09G 2320/103; G09G 2320/106
See application file for complete search history.

(56) References Cited

U.S. PATENT DOCUMENTS 9,966,003 B2 * 5/2018 Cho ..... G09G 3/20
2006/0132659 A1 6/2006 Kimura et al.
(Continued)

FOREIGN PATENT DOCUMENTS

CN 1783181 A 6/2006
CN 1918619 A 2/2007
(Continued)

OTHER PUBLICATIONS

International Search Report and Written Opinion of PCT Application No. PCT/JP2017/007464, dated May 9, 2017, 09 pages of ISRWO.
(Continued)

*Primary Examiner* — Kwang-Su Yang
(74) *Attorney, Agent, or Firm* — Chip Law Group

(57) ABSTRACT

Effective image correction processing for reducing flicker is executed according to characteristics of images, and an image to be displayed in a liquid crystal display apparatus is generated. Characteristic amount change rate data that is a change rate between a characteristic amount of a sample image and a characteristic amount of a sample image output to a liquid crystal display device is acquired in advance and stored in a storage unit. The correction parameter for reducing flicker is calculated on the basis of the characteristic amount of the image to be corrected and the characteristic amount change rate data of the sample images stored in the storage unit. The correction processing to which the calculated correction parameter has been applied is executed for the image to be corrected to generate a display image. As the
(Continued)

characteristic amount, for example, the interframe luminance change amount, the interline luminance conversion amount, or the interframe motion vector is used.

18 Claims, 17 Drawing Sheets

(56) References Cited

U.S. PATENT DOCUMENTS

| | | | | |
|---|---|---|---|---|
| 2007/0126757 | A1 | 6/2007 | Itoh et al. | |
| 2008/0284931 | A1 | 11/2008 | Kimura | |
| 2009/0102783 | A1* | 4/2009 | Hwang | G09G 3/3406 345/102 |

FOREIGN PATENT DOCUMENTS

| | | | |
|---|---|---|---|
| CN | 101303830 | A | 11/2008 |
| CN | 101308301 | A | 11/2008 |
| CN | 101409046 | A | 4/2009 |
| CN | 102289122 | A | 12/2011 |
| EP | 1667094 | A1 | 6/2006 |
| EP | 1727119 | A1 | 11/2006 |
| JP | 2003-022044 | A | 1/2003 |
| JP | 2004-306831 | A | 11/2004 |
| JP | 2005-266752 | A | 9/2005 |
| JP | 2005-266758 | A | 9/2005 |
| JP | 2006-184843 | A | 7/2006 |
| JP | 2008-058483 | A | 3/2008 |
| JP | 2008-145644 | A | 6/2008 |
| JP | 2008-184843 | A | 8/2008 |
| JP | 2008-287021 | A | 11/2008 |
| JP | 2011-164471 | A | 8/2011 |
| KR | 10-2006-0063709 | A | 6/2006 |
| KR | 10-2006-0105598 | A | 10/2006 |
| KR | 10-2006-0123780 | A | 12/2006 |
| TW | 200905346 | A | 2/2009 |
| WO | 2005/081217 | A1 | 9/2005 |

OTHER PUBLICATIONS

Office Action for JP Patent Application No. 2018-508810, dated Mar. 2, 2021, 3 pages of Office Action and 3 pages of English Translation.

* cited by examiner

EXAMPLE OF METHOD OF DRIVING MEASURES AGAINST FLICKER
FIG. 2A LINE INVERSION DRIVING METHOD
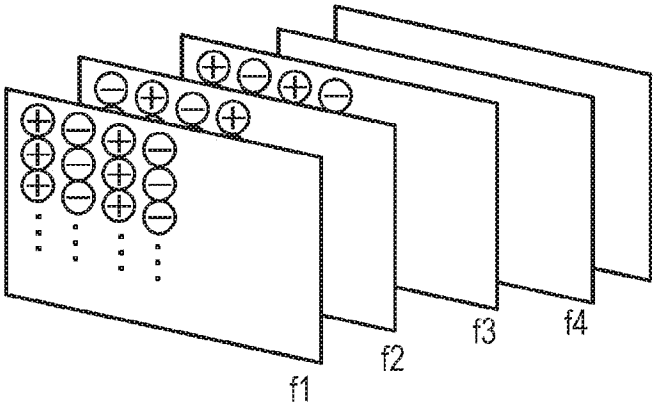
FIG. 2B DOT INVERSION DRIVING METHOD
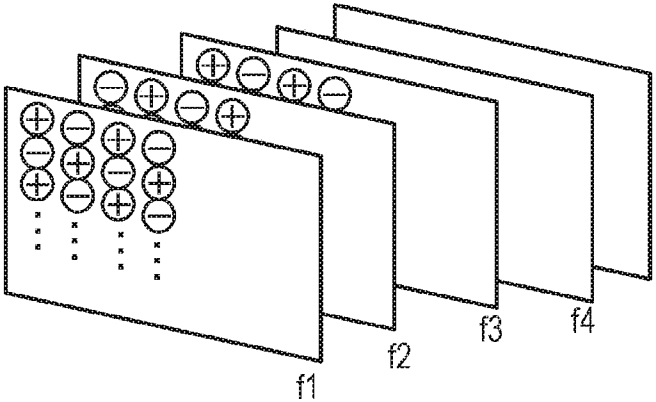

FIG. 3B OBJECT A MOVES IN RIGHT DIRECTION
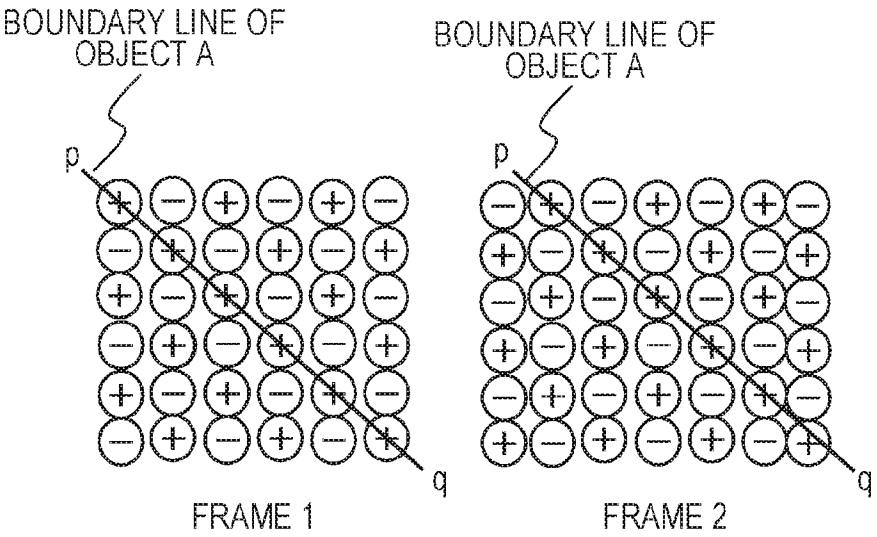
FIG. 3A
DOT INVERSION DRIVING METHOD
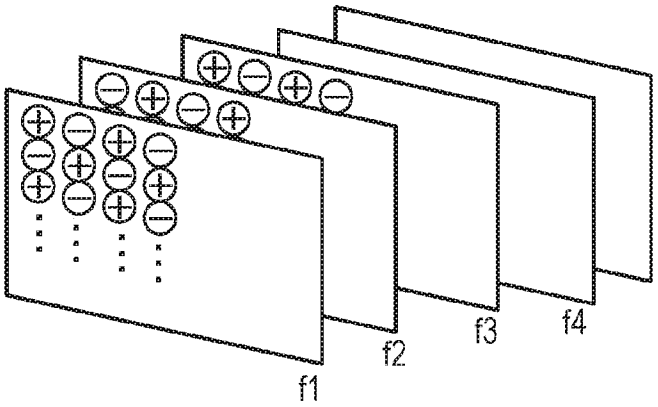

| | FIG. 6A IMAGE CHARACTERISTIC AMOUNT | | FIG. 6B MEANING |
|---|---|---|---|
| (1) | INTERFRAME LUMINANCE CHANGE AMOUNT | $\Delta Y_{frame(in)}(n)$ | DIFFERENCE IN IMAGE FRAME AVERAGE LUMINANCE BETWEEN TWO CONSECUTIVE IMAGE FRAMES |
| (2) | INTERLINE LUMINANCE CHANGE AMOUNT | $\Delta Y_{Line(in)}(n)$ | DIFFERENCE IN PIXEL LINE AVERAGE LUMINANCE BETWEEN TWO ADJACENT PIXEL LINES (CALCULATE DIFFERENCE IN EACH OF HORIZONTAL AND VERTICAL LINES) |
| (3) | INTERFRAME MOTION VECTOR | $MV_{frame(in)}(n)$ | MOTION VECTOR INDICATING MOTION AMOUNT BETWEEN FRAMES CALCULATED FROM TWO CONSECUTIVE IMAGE FRAMES |

| | FIG. 7A IMAGE CHARACTERISTIC AMOUNT | | FIG. 7B TEMPORAL CHANGE AMOUNT OF INPUT IMAGE CHARACTERISTIC AMOUNT |
|---|---|---|---|
| (1) | INTERFRAME LUMINANCE CHANGE AMOUNT | $\Delta Y_{frame(in)}(n)$ | $\alpha 1_{in}(n) = \frac{\Delta Y_{frame(in)}(n+1)}{\Delta Y_{frame(in)}(n)}$ |
| (2) | INTERLINE LUMINANCE CHANGE AMOUNT | $\Delta Y_{Line(in)}(n)$ | $\alpha 2_{in}(n) = \frac{\Delta Y_{Line(in)}(n+1)}{\Delta Y_{Line(in)}(n)}$ |
| (3) | INTERFRAME MOTION VECTOR | $MV_{frame(in)}(n)$ | $\alpha 3_{in}(n) = \frac{\Delta MV_{frame(in)}(n+1)}{\Delta MV_{frame(in)}(n)}$ |

| | FIG. 8A IMAGE CHARACTERISTIC AMOUNT | TEMPORAL CHANGE AMOUNT OF INPUT FIG. 8B IMAGE CHARACTERISTIC AMOUNT | TEMPORAL CHANGE AMOUNT OF OUTPUT FIG. 8C IMAGE CHARACTERISTIC AMOUNT | FIG. 8D CHARACTERISTIC AMOUNT CHANGE RATE OF INPUT/OUTPUT IMAGES |
|---|---|---|---|---|
| (1) | INTERFRAME LUMINANCE CHANGE AMOUNT $\Delta Y_{frame(in)}(n)$ | FIG. 7A $\alpha 1_{in}(n) = \frac{\Delta Y_{frame(in)}(n+1)}{\Delta Y_{frame(in)}(n)}$ | $\alpha 1_{out}(n) = \frac{\Delta Y_{frame(out)}(n+1)}{\Delta Y_{frame(out)}(n)}$ | $\alpha 1(n) = \frac{\alpha 1_{out}(n)}{\alpha 1_{in}(n)}$ |
| (2) | INTERLINE LUMINANCE CHANGE AMOUNT $\Delta Y_{Line(in)}(n)$ | $\alpha 2_{in}(n) = \frac{\Delta Y_{Line(in)}(n+1)}{\Delta Y_{Line(in)}(n)}$ | $\alpha 2_{out}(n) = \frac{\Delta Y_{Line(out)}(n+1)}{\Delta Y_{Line(out)}(n)}$ | $\alpha 2(n) = \frac{\alpha 2_{out}(n)}{\alpha 2_{in}(n)}$ |
| (3) | INTERFRAME MOTION VECTOR $MV_{frame(in)}(n)$ | $\alpha 3_{in}(n) = \frac{\Delta MV_{frame(in)}(n+1)}{\Delta MV_{frame(in)}(n)}$ | $\alpha 3_{out}(n) = \frac{\Delta MV_{frame(out)}(n+1)}{\Delta MV_{frame(out)}(n)}$ | $\alpha 3(n) = \frac{\alpha 3_{out}(n)}{\alpha 3_{in}(n)}$ |

| | FIG. 9A IMAGE CHARACTERISTIC AMOUNT | | FIG. 9B CHARACTERISTIC AMOUNT CHANGE RATE OF INPUT/OUTPUT IMAGES |
|---|---|---|---|
| (1) | INTERFRAME LUMINANCE CHANGE AMOUNT | $\Delta Y_{frame(in)}(n)$ | $\alpha 1(n) = \frac{\alpha 1_{out}(n)}{\alpha 1_{in}(n)}$ |
| (2) | INTERLINE LUMINANCE CHANGE AMOUNT | $\Delta Y_{Line(in)}(n)$ | $\alpha 2(n) = \frac{\alpha 2_{out}(n)}{\alpha 2_{in}(n)}$ |
| (3) | INTERFRAME MOTION VECTOR | $MV_{frame(in)}(n)$ | $\alpha 3(n) = \frac{\alpha 3_{out}(n)}{\alpha 3_{in}(n)}$ |

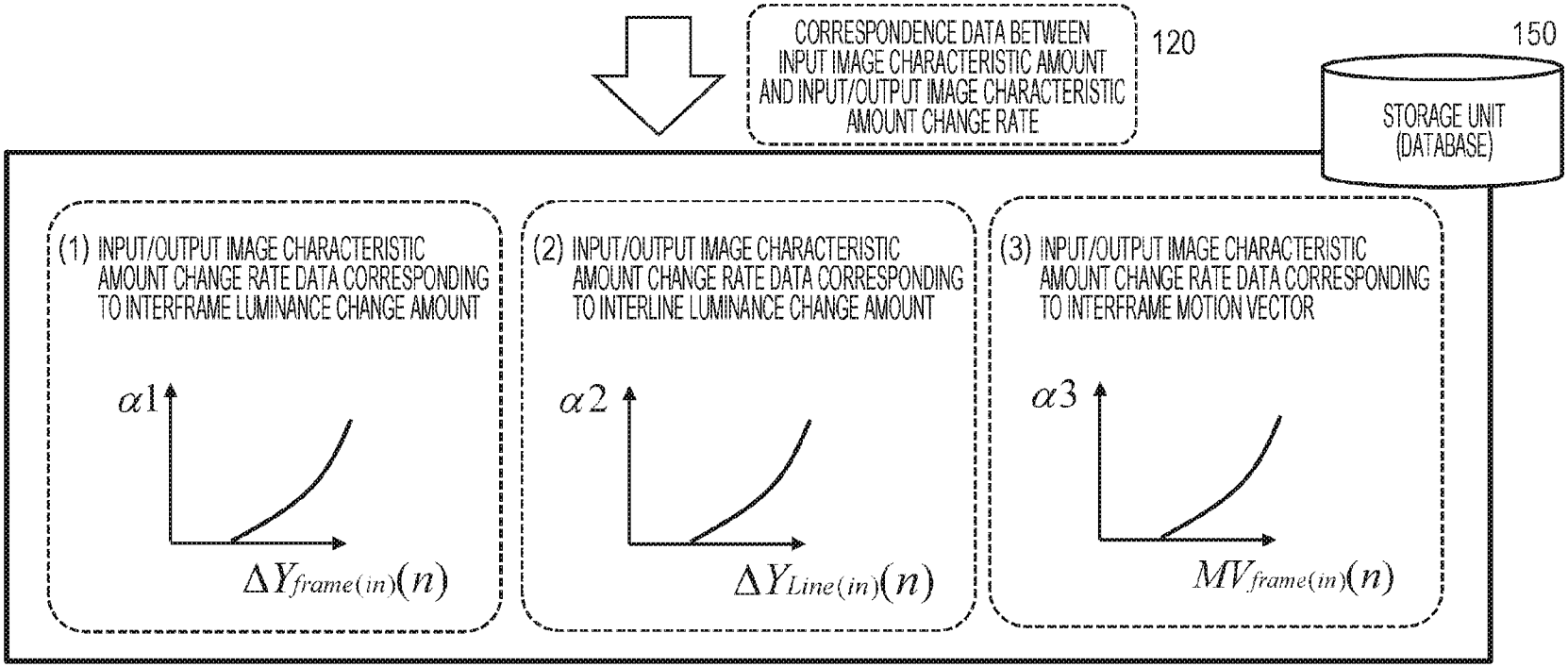

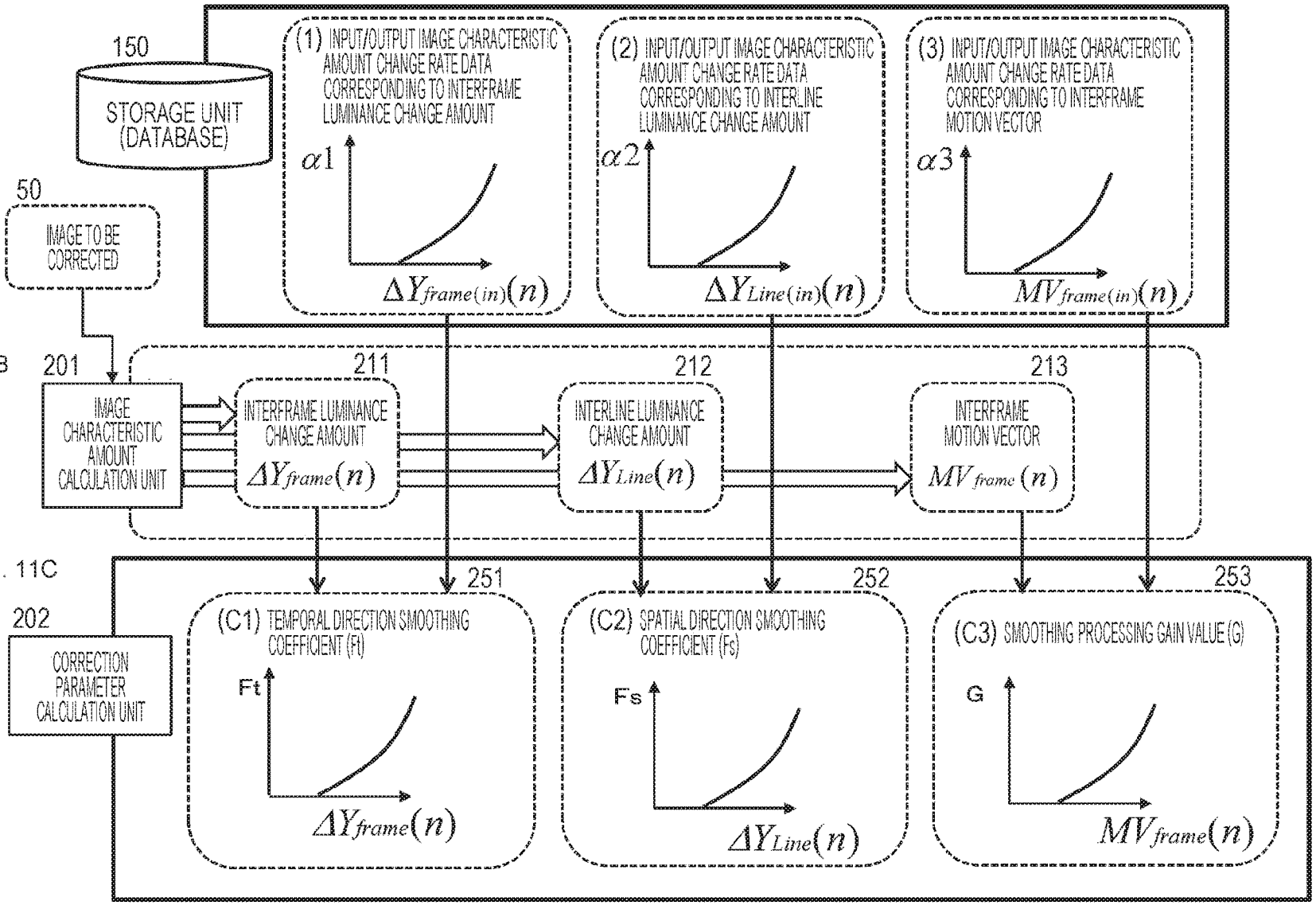
FIG. 11A
(1) INPUT/OUTPUT IMAGE CHARACTERISTIC AMOUNT CHANGE RATE DATA CORRESPONDING TO INTERFRAME LUMINANCE CHANGE AMOUNT
α1
ΔY_frame(in)(n)
(2) INPUT/OUTPUT IMAGE CHARACTERISTIC AMOUNT CHANGE RATE DATA CORRESPONDING TO INTERLINE LUMINANCE CHANGE AMOUNT
α2
ΔY_Line(in)(n)
(3) INPUT/OUTPUT IMAGE CHARACTERISTIC AMOUNT CHANGE RATE DATA CORRESPONDING TO INTERFRAME MOTION VECTOR
α3
MV_frame(in)(n)
150
STORAGE UNIT (DATABASE)
50
IMAGE TO BE CORRECTED
201
IMAGE CHARACTERISTIC AMOUNT CALCULATION UNIT
FIG. 11B
211
INTERFRAME LUMINANCE CHANGE AMOUNT
ΔY_frame(n)
212
INTERLINE LUMINANCE CHANGE AMOUNT
ΔY_Line(n)
213
INTERFRAME MOTION VECTOR
MV_frame(n)
FIG. 11C
251
(C1) TEMPORAL DIRECTION SMOOTHING COEFFICIENT (Ft)
Ft
ΔY_frame(n)
252
(C2) SPATIAL DIRECTION SMOOTHING COEFFICIENT (Fs)
Fs
ΔY_Line(n)
253
(C3) SMOOTHING PROCESSING GAIN VALUE (G)
G
MV_frame(n)
202
CORRECTION PARAMETER CALCULATION UNIT

LIQUID CRYSTAL DISPLAY APPARATUS AND LIQUID CRYSTAL DISPLAY CONTROL METHOD FOR IMAGE CORRECTION

CROSS REFERENCE TO RELATED APPLICATIONS

This application is a U.S. National Phase of International Patent Application No. PCT/JP2017/007464 filed on Feb. 27, 2017, which claims priority benefit of Japanese Patent Application No. JP 2016-065533 filed in the Japan Patent Office on Mar. 29, 2016. Each of the above-referenced applications is hereby incorporated herein by reference in its entirety.

TECHNICAL FIELD

The present disclosure relates to a liquid crystal display apparatus, a liquid crystal display control method, and a program. In more details, the present disclosure relates to a liquid crystal display apparatus, a liquid crystal display control method, and a program that realize high quality display with reduced flicker.

BACKGROUND ART

At present, liquid crystal display apparatuses are used in various display devices such as televisions, PCs, and smartphones.

Many of the liquid crystal display apparatuses are driven by an AC voltage to avoid degradation of liquid crystal. As a driving method of a liquid crystal panel by an AC voltage, there are a dot inversion driving method of switching positive and negative polarities on a pixel basis, a line inversion driving method of switching positive and negative polarities on a line basis, a frame inversion driving method of switching positive and negative polarities on a frame basis, and the like.

The liquid crystal panel is driven by using any of the methods or in combination of the methods.

However, such a driving method has a problem of occurrence of flicker caused by a voltage difference between positive and negative polarities.

Note that there is Patent Document 1 (Japanese Patent Application Laid-Open No. 2011-164471) and the like, for example, as a conventional technology disclosing the problem of flicker in a liquid crystal display apparatus.

Patent Document 1 discloses a configuration in which a light shielding body is provided on a liquid crystal panel and measures against flicker caused by a special factor are applied.

However, recently, high-definition panels, such as 4K displays, become popular and display images have been made finer, and the flicker becomes more conspicuous accordingly, causing a problem of an increase in visual discomfort.

Furthermore, it may be difficult to observe the flicker or it may be easy to observe the flicker depending on an individual difference of the liquid crystal panel and characteristics of the display image, and there is a problem that uniform control is difficult.

Although Patent Document 1 above and other conventional technologies disclose various flicker reduction configurations, they fail to disclose a configuration to execute flicker reduction processing according to characteristics of the liquid crystal panel or characteristics of the display image.

CITATION LIST

Patent Document

Patent Document 1: Japanese Patent Application Laid-Open No. 2011-164471

SUMMARY OF THE INVENTION

Problems to be Solved by the Invention

The present disclosure has been made in view of the above-described problems, and an object of the present disclosure is to provide a liquid crystal display apparatus, a liquid crystal display control method, and a program that perform control in consideration of characteristics of a liquid crystal panel and characteristics of a display device, and realize effective flicker reduction, for example.

Solutions to Problems

A first aspect of the present disclosure is a liquid crystal display apparatus including:

a storage unit configured to store a characteristic amount change rate that is a change rate between a characteristic amount of a sample image and a characteristic amount of an output sample image with respect to a liquid crystal display device;

a characteristic amount extraction unit configured to extract a characteristic amount of an image to be corrected;

a correction parameter calculation unit configured to calculate a correction parameter for reducing flicker on the basis of the characteristic amount of the image to be corrected and the characteristic amount change rate; and an image correction unit configured to execute, for the image to be corrected, correction processing to which the correction parameter has been applied.

Moreover, a second aspect of the present disclosure is a liquid crystal display apparatus including:

an offline processing unit configured to calculate a characteristic amount change rate that is a change rate between a characteristic amount of a sample image and a characteristic amount of an output sample image with respect to a liquid crystal display device;

a storage unit configured to store the characteristic amount change rate calculated by the offline processing unit; and an online processing unit configured to apply the characteristic amount change rate stored in the storage unit and execute correction processing of an image to be corrected, in which the online processing unit includes a characteristic amount extraction unit configured to extract a characteristic amount of the image to be corrected, a correction parameter calculation unit configured to calculate a correction parameter for reducing flicker on the basis of the characteristic amount of the image to be corrected and the characteristic amount change rate, and an image correction unit configured to execute, for the image to be corrected, correction processing to which the correction parameter has been applied.

Moreover, a third aspect of the present disclosure is a liquid crystal display control method executed in a liquid crystal display apparatus, the liquid display apparatus including a storage unit configured to store a characteristic amount change rate that is a change rate between a characteristic amount of a sample image and a characteristic amount of an output sample image with respect to a liquid crystal display device, the liquid crystal display control method including:

by a characteristic amount extraction unit, extracting a characteristic amount of an image to be corrected;

by a correction parameter calculation unit, calculating a correction parameter for reducing flicker on the basis of the characteristic amount of the image to be corrected and the characteristic amount change rate; and by an image correction unit, executing, for the image to be corrected, correction processing to which the correction parameter has been applied and outputting the image to be corrected on a display unit.

Moreover, a fourth aspect of the present disclosure is a liquid crystal display control method executed in a liquid crystal display apparatus, the liquid crystal display control method including:

by an offline processing unit, executing an offline processing step of calculating a characteristic amount change rate that is a change rate between a characteristic amount of a sample image and a characteristic amount of an output sample image with respect to a liquid crystal display device, and storing the characteristic amount change rate in a storage unit; and by an online processing unit, extracting a characteristic amount of an image to be corrected, calculating a correction parameter for reducing flicker on the basis of the characteristic amount of the image to be corrected and the characteristic amount change rate stored in the storage unit, and executing, for the image to be corrected, correction processing to which the correction parameter has been applied, and displaying the image to be corrected on a display unit.

Moreover, a fifth aspect of the present disclosure is a program for executing liquid crystal display control processing in a liquid crystal display apparatus, the liquid display apparatus including a storage unit configured to store a characteristic amount change rate that is a change rate between a characteristic amount of a sample image and a characteristic amount of an output sample image with respect to a liquid crystal display device, the program generating a corrected image for a display unit output by executing:

characteristic amount extraction processing of an image to be corrected in a characteristic amount extraction unit;

processing of calculating a correction parameter for reducing flicker based on a characteristic amount of the image to be corrected and the characteristic amount change rate in a correction parameter calculation unit; and correction processing to which the correction parameter has been applied for the image to be corrected in an image correction unit.

Moreover, a sixth aspect of the present disclosure is a program for executing liquid crystal display control processing in a liquid crystal display apparatus, the program generating a corrected image for a display unit output by causing:

an offline processing unit to execute offline processing of calculating a characteristic amount change rate that is a change rate between a characteristic amount of a sample image and a characteristic amount of an output sample image with respect to a liquid crystal display device, and storing the characteristic amount change rate in a storage unit; and an online processing unit to execute characteristic amount extraction processing of an image to be corrected, processing of calculating a correction parameter for reducing flicker based on the characteristic amount of the image to be corrected and the characteristic amount change rate stored in the storage unit, and correction processing to which the correction parameter has been applied, for the image to be corrected.

Note that the program of the present disclosure is, for example, a program that can be provided by a storage medium or a communication medium provided in a computer readable format to an information processing apparatus or a computer system that can execute various program codes. By providing such a program in the computer readable format, processing according to the program is realized on the information processing apparatus or the computer system.

Still other objects, characteristics, and advantages of the present disclosure will be apparent from detailed description based on embodiments and attached drawings of the present disclosure to be described below. Note that the system in the present specification is a logical aggregate configuration of a plurality of devices, and is not limited to devices having respective configurations within the same housing.

Effects of the Invention

According to a configuration of one embodiment of the present disclosure, effective image correction processing for reducing flicker according to characteristics of images is executed, and the flicker of an image to be displayed on the liquid crystal display apparatus can be effectively reduced.

Specifically, characteristic amount change rate data which is the change rate between the characteristic amount of the sample image and the characteristic amount of the sample image output to the liquid crystal display device is acquired in advance and stored in the storage unit. The correction parameter for reducing flicker is calculated on the basis of the characteristic amount of the image to be corrected and the characteristic amount change rate data of the sample images stored in the storage unit. The correction processing to which the calculated correction parameter has been applied is executed for the image to be corrected to generate a display image. As the characteristic amount, for example, the interframe luminance change amount, the interline luminance conversion amount, or the interframe motion vector is used.

With the configuration, the effective image correction processing for reducing flicker according to the characteristics of images is executed, and the flicker of the image to be displayed on the liquid crystal display apparatus can be effectively reduced.

Note that effects described in the present specification are merely illustrative and are not restrictive, and there may be additional effects.

BRIEF DESCRIPTION OF DRAWINGS

FIGS. 2A and 2B are diagrams for describing a technique for reducing flicker of a liquid crystal panel.

FIGS. 3A and 3B are diagrams for describing flicker in the case of a moving image in which an object in an image displayed in consecutive image frames moves.

FIGS. 6A and 6B are diagrams for describing an example of characteristic amounts acquired from a sample image by an image characteristic amount calculation unit.

FIGS. 7A and 7B are diagrams illustrating three types of image characteristic amounts, and temporal change amounts of input image characteristic amounts calculated by an image temporal change amount calculation unit.

FIGS. 8A, 8B, 8C, and 8D are diagrams for describing (a) an image characteristic amount, (b) a temporal change amount of an input image characteristic amount, (c) a temporal change amount of an output image characteristic amount, and (d) a characteristic amount change rate of input/output images.

FIGS. 9A and 9B are diagrams for describing "correspondence data between an input image characteristic amount and a characteristic amount change rate of input/output images" stored in a storage unit (database).

FIGS. 11A, 11B, and 11C are diagrams for describing a specific example of correction parameter calculation processing executed by a correction parameter calculation unit.

MODE FOR CARRYING OUT THE INVENTION

Figures 1A, 1B:
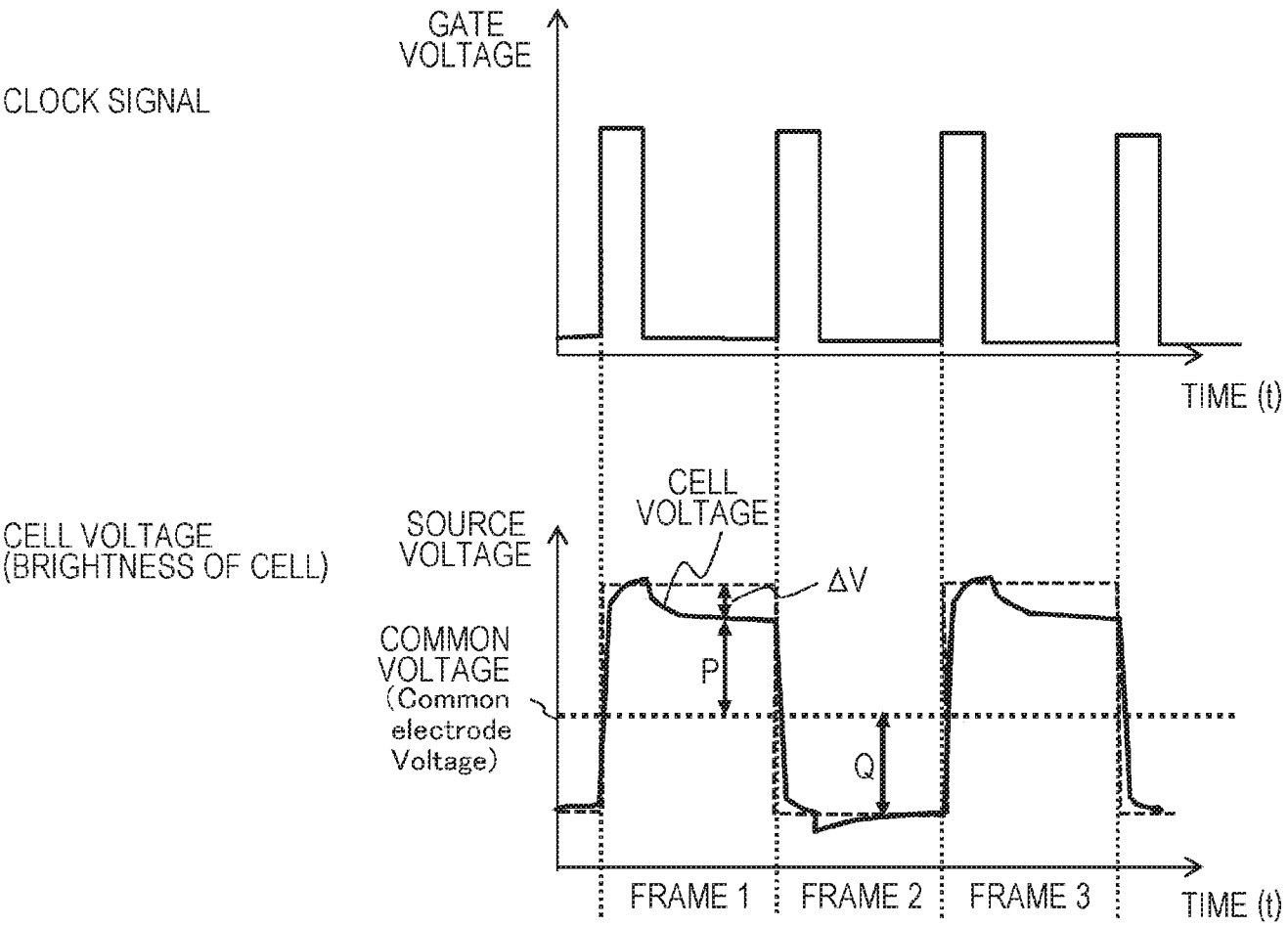
FIGS. 1A and 1B are diagrams for describing drive processing of a panel in the case of displaying an image in a liquid crystal display apparatus.

Hereinafter, details of a liquid crystal display apparatus, a liquid crystal display control method, and a program of the present disclosure will be described with reference to the drawings. Note that the description will be given according to the following items.

1. Outline of image display processing in liquid crystal display apparatus
2. Configuration for realizing flicker reduction processing corresponding to image characteristics and display unit characteristics
3. Configuration example and processing example of offline processing unit
4. Configuration example and processing example of online processing unit
5. Sequence of processing executed by liquid crystal display apparatus
5-1. Sequence of processing executed by offline processing unit
5-2. Sequence of Processing Example 1 executed by online processing unit
5-3. Sequence of Processing Example 2 executed by online processing unit
6. Hardware configuration example of liquid crystal display apparatus
7. Summary of configuration of present disclosure

1. Outline of Image Display Processing in Liquid Crystal Display Apparatus

First, an outline of image display processing in a liquid crystal display apparatus will be described.

FIGS. 1A and 1B are diagrams for describing drive processing of a panel in the case of displaying an image in a liquid crystal display apparatus.

There is a plurality of driving methods for a liquid crystal panel. For example, there are a common DC method, a common inversion method, and the like. FIGS. 1A and 1B are diagrams for describing panel drive processing according to the common DC method.

FIGS. 1A and 1B illustrate the following drawings.

FIG. 1A A clock signal

FIG. 1B A cell voltage (≈brightness of cell)

The horizontal axes of both the graphs represent time (t).

The vertical axis represents a gate voltage in the graph of (a) the clock signal and a source voltage in the graph of (b) the cell voltage.

The source voltage varies according to the clock signal.

The curve in the graph of (b) the cell voltage illustrates a curve illustrating the change of the cell voltage of a certain pixel in three consecutive image frames 1 to 3 displayed on the liquid crystal panel.

A difference from a common voltage illustrated by the dotted line in approximately the center of the vertical axis is output as luminance (brightness) of the pixel.

In the graph of (b), the voltage is larger than the common voltage in the frame 1 and the voltage is smaller than the common voltage in the frame 2.

Since the difference from the common voltage corresponds to the brightness of the pixel, if a difference P of the frame 1 and a difference Q of the frame 2 are equal, the luminance of the pixel in each frame is constant and flicker does not occur.

However, actual source voltage change exhibits a curve as illustrated in FIG. 1B due to a characteristic of a transistor.

The difference P of the frame 1 is smaller than the difference Q of the frame 2 and a frame luminance difference of $Q-P=\Delta V$ occurs.

This frame luminance difference $\Delta V$ causes a difference in brightness in the pixel at the same position of the frame 1 and the frame 2.

Similar brightness fluctuation is repeated in the frames 1, 2, 3, 4, and the like. As a result, flicker occurs.

As a technique for reducing the flicker of the liquid crystal panel due to the driving on a frame basis, there is a technique of switching an applied voltage on a line basis of one image frame or a dot (pixel) basis.

These driving methods will be described with reference to FIGS. 2A and 2B.

FIG. 2A is a diagram illustrating processing of a line driving method.

An applied voltage (+) or (−) of each pixel is illustrated from an image frame f1 to image frames f2, f3, f4, and the like.

In the example illustrated in FIG. 2A, (+) and (−) are alternately set to every other vertical line, and this setting is switched at every switching of each frame.

FIG. 2B is a diagram illustrating processing of the dot driving method. An applied voltage (+) or (−) of each pixel is illustrated from an image frame f1 to image frames f2, f3, f4, and the like.

In the example illustrated in FIG. 2B, (+) and (−) are alternately set to every other pixel (dot), and this setting is switched at every switching of each frame.

The flicker is unlikely to be perceived by the applied voltage switching processing as illustrated in FIGS. 2A and 2B. This is because an image with brightness to which a pixel value on a pixel region basis constituted by several front and back frames or a plurality of front and back pixels is added is recognized as a visual observation image by a visual integration effect. In other words, the difference in brightness in each frame or on a pixel basis becomes less easily perceived, and observation of an image with decreased flicker becomes possible.

However, although the method illustrated in FIGS. 2A and 2B has an effect of reducing the flicker in an image in which the same image is consecutively displayed between front and back frames, like a still image, the flicker may become rather conspicuous in a moving image in which an object moves in the image.

This phenomenon will be described with reference to FIGS. 3A and 3B.

FIG. 3A is a diagram illustrating the processing of the dot driving method described with reference to FIG. 2B.

FIG. 3B illustrates the image frames 1 and 2 driven by the dot driving method.

In these image frames, an object A moving in a right direction is displayed. A line pq illustrated in the frames 1 and 2 is one boundary line of the object A.

The boundary line pq in the frame 1 is displayed at a position shifted in the right by one pixel in the next frame 2.

When such movement of the object occurs, the boundary line pq of the object A is always positioned along the line where the applied voltage is (+) in consecutive image frames.

As a result, the boundary line pq of the object A is continuously displayed as pixels having a fixed luminance difference from adjacent pixels, that is, pixels of the applied voltage (−), and is observed as if a line with luminance different from the surroundings flows on the screen.

As described above, even when the measures against flicker described with reference to FIGS. 2A and 2B is applied, a sufficient flicker reduction effect may not be exhibited depending on a characteristic of the image.

2. Configuration for Realizing Flicker Reduction Processing Corresponding to Image Characteristics and Display Unit Characteristics Next, a configuration for realizing flicker reduction processing corresponding to image characteristics and display unit characteristics will be described.

Figure 4:
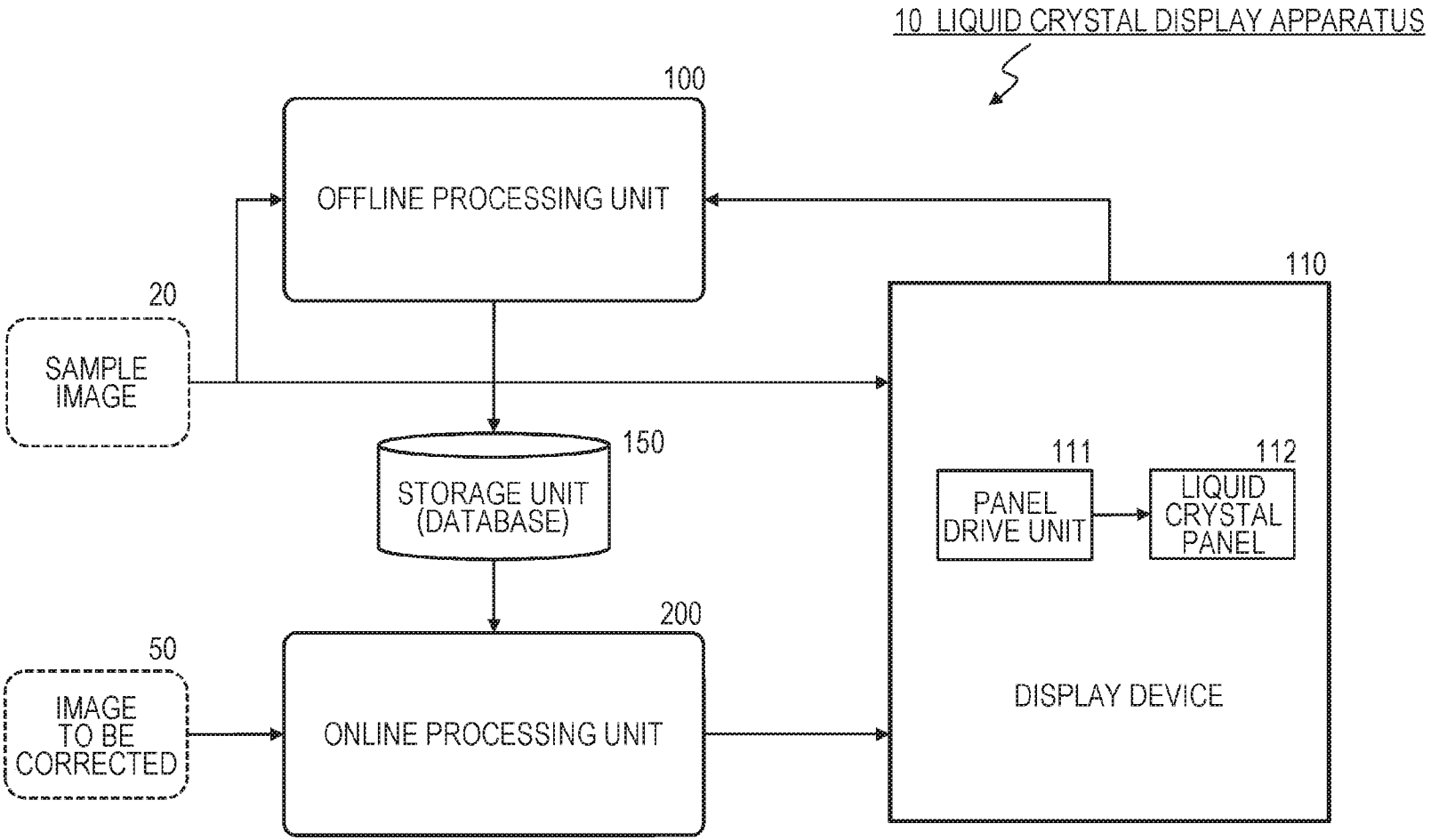
FIG. 4 is a diagram illustrating a configuration example of the liquid crystal display apparatus of the present disclosure.

FIG. 4 is a diagram illustrating a configuration example of the liquid crystal display apparatus of the present disclosure.

A liquid crystal display apparatus 10 of the present disclosure includes an offline processing unit 100, a display device 110, a database 150, and an online processing unit 200.

The display device 110 includes a panel drive unit 111 and a liquid crystal panel 112.

Note that the liquid crystal display apparatus 10 illustrated in FIG. 4 is a configuration example of the liquid crystal display apparatus of the present disclosure.

The offline processing unit 100 sequentially inputs sample images 20 having various different characteristics. Further, the offline processing unit 100 inputs output image data and the like of the sample image displayed on the display device 110.

The offline processing unit 100 analyzes characteristics of the sample image 20 and the output image displayed on the display device 110, generates data to be applied to image correction processing in the online processing unit 200 on the basis of an analysis result, and accumulates the data in the storage unit (database) 150.

The image correction processing executed in the online processing unit 200 is correction processing executed for the purpose of reducing flicker, and the offline processing unit 100 compares a characteristic amount of the sample image having various characteristics with a characteristic amount of the output image output to the display device 110, generates data to be applied to correction processing for executing optimal flicker reduction for various images, and accumulates the data in the storage unit (database) 150.

The online processing unit 200 inputs image to be corrected data 50, executes the image correction processing using the data stored in the storage unit (database) 150, and outputs a corrected image to the display device 110 to display the corrected image.

Note that the image correction processing in the online processing unit 200 is correction processing executed for the purpose of reducing flicker.

The data accumulation processing for the storage unit (database) 150 in the offline processing unit 100 is executed prior to the image correction processing in the online processing unit 200.

After the data is stored in the storage unit (database) 150, the offline processing unit is disconnected and the online processing unit 200 can execute correction for reducing flicker using the data stored in the storage unit 150, and can display an image on the display device 110.

Accordingly, a configuration in which the offline processing unit 100 is omitted may be used as a configuration example of the liquid crystal display apparatus of the present disclosure.

Hereinafter, specific configuration examples and processing examples of the offline processing unit 100 and the online processing unit 200 will be described in order.

3. Configuration Example and Processing Example of Offline Processing Unit

Next, a configuration and a processing example of the offline processing unit 100 of the liquid crystal display apparatus 10 illustrated in FIG. 4 will be described.

As described with reference to FIG. 4, the offline processing unit 100 inputs the sample image 20 having various different characteristics, and further inputs the output image data of the sample images and the like displayed on the display device 110. The offline processing unit 100 analyzes the characteristics of the images, generates the data to be applied to the image correction processing in the online processing unit 200 on the basis of the analysis result, and accumulates the data in the storage unit (database) 150.

Figure 5:
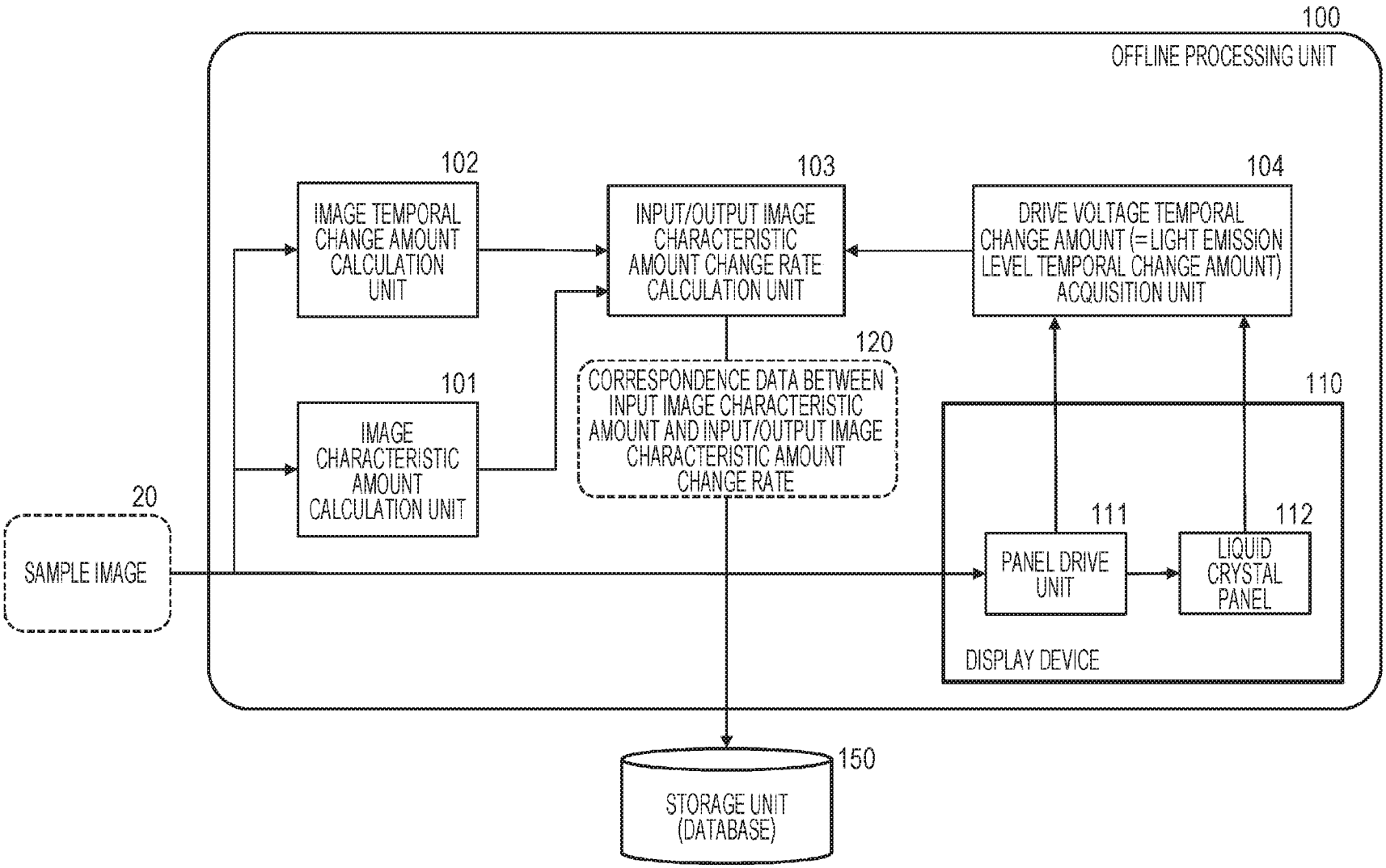
FIG. 5 is a block diagram illustrating a configuration example of an offline processing unit of the liquid crystal display apparatus.

FIG. 5 is a block diagram illustrating a configuration example of the offline processing unit 100 of the liquid crystal display apparatus 10 illustrated in FIG. 4.

As illustrated in FIG. 5, the offline processing unit 100 includes an image characteristic amount calculation unit 101, an image temporal change amount calculation unit 102, an input/output image characteristic amount change rate calculation unit 103, and a drive voltage temporal change amount (light emission level temporal change amount) acquisition unit 104.

The offline processing unit 100 inputs the sample image 20 having various different characteristics, generates the data to be applied to the image correction processing in the online processing unit 200, and accumulates the data in the storage unit (database) 150.

Note that FIG. 5 illustrates the display device 110 including the panel drive unit 111 and the liquid crystal panel 112 as a constituent element of the offline processing unit 100.

The display device 110 is the display device 110 illustrated in FIG. 4 and is a display device commonly used both in the processing of the offline processing unit 100 and the processing of the online processing unit 200.

As described above, the display device 110 is an independent element and is also used as a constituent element of the offline processing unit 100 and of the online processing unit 200.

Processing executed by the offline processing unit 100 illustrated in FIG. 5 will be described.

The image characteristic amount calculation unit 101 inputs the sample image 20 having various different characteristics, analyzes the input sample image 20, and calculates various characteristic amounts from each sample image.

An example of the characteristic amounts acquired from the sample image 20 by the image characteristic amount calculation unit 101 will be described with reference to FIGS. 6A and 6B.

As illustrated in FIGS. 6A and 6B, the image characteristic amount calculation unit 101 acquires the following image characteristic amounts from the sample image 20.

(1) An interframe luminance change amount: ΔYframe(in)(n)

(2) An interline luminance change amount: ΔYline(in)(n)

(3) An interframe motion vector: MVframe(in)(n)

Note that the input sample images 20 include various different images such as moving images and still images. In the case of a moving image, a moving object is included in consecutive image frames.

"(1) The interframe luminance change amount: $\Delta Y_{frame(in)}$ (n)" is a difference in image frame average luminance between two consecutive image frames.

n in $\Delta Y_{frame(in)}$ (n) means a frame number, ΔY means a difference in luminance (Y), and (in) means an input image. $\Delta Y_{frame(in)}$ (n) means a difference in frame average luminance between two consecutive input frames of a frame n and a frame n+1.

"(2) The interline luminance change amount: $\Delta Y_{line(in)}$ (n)" is a difference in pixel line average luminance between adjacent pixel lines in one image frame.

n in $\Delta Y_{line(in)}$ (n) means a frame number, ΔY means a difference in luminance (Y), and (in) means an input image. $\Delta Y_{line(in)}$ (n) means a difference in pixel line average luminance of an input frame n.

Note that the interline luminance change amount is calculated for each of a horizontal line and a vertical line.

"(3) The interframe motion vector: $MV_{frame(in)}$ (n)" is a motion vector indicating a motion amount between frames calculated from two consecutive image frames.

n in $MV_{frame(in)}$ (n) means a frame number, MV means a motion vector, and (in) means an input image. $MV_{frame(in)}$ (n) means a motion vector indicating a motion amount of two consecutive input frames of a frame n and a frame n+1.

The image characteristic amount calculation unit 101 calculates these three types of image characteristic amounts, and inputs the calculated image characteristic amounts to the input/output image characteristic amount change rate calculation unit 103, for example.

Next, processing executed by the image temporal change amount calculation unit 102 will be described.

The image temporal change amount calculation unit 102, for example, calculates a temporal change amount of each characteristic amount, using the image characteristic amounts of two consecutive frames input as the sample image 20, that is, the image frame n and the image frame n+1.

An example of the temporal change amount of input image characteristic amounts acquired from the two consecutive frames (frames n and n+1) input as the sample image 20 by the image temporal change amount calculation unit 102 will be described with reference to FIGS. 7A and 7B.

FIGS. 7A and 7B illustrate the three types of image characteristic amounts [FIG. 7A image characteristic amounts] calculated by the image characteristic amount calculation unit 101 described with reference to FIGS. 6A and 6B, and [FIG. 7B the temporal change amount of the input image characteristic amount] calculated by the image temporal change amount calculation unit 102 in association with each other.

As illustrated in FIGS. 7A and 7B, the image temporal change amount calculation unit 102 calculates the temporal change amount of each of the three types of image characteristic amounts [FIG. 7A image characteristic amounts] calculated by the image characteristic amount calculation unit 101, that is, the change amount of the characteristic amounts of the two consecutive frames (frames n and n+1) as [FIG. 7B the temporal change amount of the input image characteristic amount].

The image temporal change amount calculation unit 102 acquires the temporal change amounts of the following image characteristic amounts acquired from the two consecutive frames (frames n and n+1) input as the sample image 20.

(1) The temporal change amount of the interframe luminance change amount: $\alpha 1_{in}(n)$ (2) The temporal change amount of the interline luminance change amount: $\alpha 2_{in}(n)$ (3) The temporal change amount of the interframe motion vector: $\alpha 3_{in}(n)$ $\alpha 1_{in}(n)$, $\alpha 2_{in}(n)$, and $\alpha 3_{in}(n)$ are expressed by the following expressions (Expressions 1a to 1c).

[Math. 1]

$$\alpha 1_{in}(n) = \frac{\Delta Y_{frame(in)}(n+1)}{\Delta Y_{frame(in)}(n)} \quad \text{(Expression 1a)}$$

$$\alpha 2_{in}(n) = \frac{\Delta Y_{Line(in)}(n+1)}{\Delta Y_{Line(in)}(n)} \quad \text{(Expression 1b)}$$

$$\alpha 3_{in}(n) = \frac{\Delta MV_{frame(in)}(n+1)}{\Delta MV_{frame(in)}(n)} \quad \text{(Expression 1c)}$$

In this manner, the image temporal change amount calculation unit 102 acquires the temporal change amounts of the three types of image characteristic amounts acquired from the two consecutive frames (frames n and n+1) input as the sample image 20.

The image temporal change amount calculation unit 102 calculates the temporal change amounts of the three types of image characteristic amounts, and inputs the calculated temporal change amounts of the image characteristic amounts to the input/output image characteristic amount change rate calculation unit 103, for example.

Next, processing executed by the input/output image characteristic amount change rate calculation unit 103 and the drive voltage temporal change amount (light emission level temporal change amount) acquisition unit 104 will be described.

The drive voltage temporal change amount (light emission level temporal change amount) acquisition unit 104 acquires a temporal change amount of a drive voltage of the sample image 20 displayed on the display device 110. The drive voltage corresponds to the cell voltage described with reference to FIG. 1B, for example, and corresponds to the luminance of each pixel.

In other words, the drive voltage temporal change amount (light emission level temporal change amount) acquisition unit 104 calculates the temporal change amounts ($\alpha$1out(n), $\alpha$2out(n), and $\alpha$3out(n)) of the characteristic amounts of the image (output image) displayed on the liquid crystal panel 112.

The temporal change amounts ($\alpha 1_{out}$(n), $\alpha 2_{out}$(n), and $\alpha 3_{out}$(n)) of the characteristic amounts of the image (output image) displayed on the liquid crystal panel 112 are the following temporal change amounts of the characteristic amounts of the output image.

(1) The temporal change amount of the interframe luminance change amount: $\alpha 1_{Out}$(n)

(2) The temporal change amount of the interline luminance change amount: $\alpha 2_{Out}$(n)

(3) The temporal change amount of the interframe motion vector: $\alpha 3_{Out}$(n)

The input/output image characteristic amount change rate calculation unit 103 calculates characteristic amount change rates ($\alpha$1 (n), $\alpha$2 (n), and $\alpha$3 (n)) of the input/output images by inputting the characteristic amount temporal change amounts ($\alpha 1_{in}$ (n), $\alpha 2_{in}$(n), and $\alpha 3_{in}$(n)) corresponding to the input image (input sample image) input from the image temporal change amount calculation unit 102, the characteristic amount temporal change amounts ($\alpha 1_{out}$ (n), $\alpha 2_{out}$(n), and $\alpha 3_{out}$(n)) corresponding to the output image (output sample image) input from the drive voltage temporal change amount (light emission level temporal change amount) acquisition unit 104, and the temporal change amounts of the image characteristic amounts of each of the input/output images.

FIGS. 8A, 8B, 8C, and 8D illustrate a diagram for describing a correspondence relationship among "FIG. 8C the temporal change amount of the output image characteristic amount" calculated by the drive voltage temporal change amount (light emission level temporal change amount) acquisition unit 104, "FIG. 8D the characteristic amount change rate of the input/output images" calculated by the input/output image characteristic amount change rate calculation unit 103, and the like.

FIGS. 8A, 8B, 8C, and 8D illustrate the following data in association with one another.

FIG. 8A The image characteristic amount

FIG. 8B The temporal change amount of the input image characteristic amount

FIG. 8C The temporal change amount of the output image characteristic amount FIG. 8D The characteristic amount change rate of the input/output images "FIG. 6A The image characteristic amount" refers to the three types of image characteristic amounts calculated from the input image (sample image 20) by the image characteristic amount calculation unit 101. As described with reference to FIGS. 6A and 6B, there are the following three types of characteristic amounts.

(1) An interframe luminance change amount: $\Delta$Yframe (in)(n)

(2) An interline luminance change amount: $\Delta$Yline(in)(n)

(3) An interframe motion vector: MVframe(in)(n)

"FIG. 7B The temporal change amount of the input image characteristic amount" is calculated by the image temporal change amount calculation unit 102. As described with reference to FIGS. 7A and 7B, the image temporal change amount calculation unit 102 calculates the temporal change amount of each of the three types of image characteristic amounts [FIG. 6A image characteristic amounts] calculated by the image characteristic amount calculation unit 101, that is, the change amount of the characteristic amounts of the two consecutive frames (frames n and n+1) as [FIG. 7B the temporal change amount of the input image characteristic amount].

"(c) The temporal change amount of the output image characteristic amount" is calculated by the drive voltage temporal change amount (light emission level temporal change amount) acquisition unit 104 illustrated in FIG. 5. The drive voltage temporal change amount (light emission level temporal change amount) acquisition unit 104 acquires the temporal change amount of the drive voltage of the sample image 20 displayed on the display device 110, and calculates the temporal change amounts ($\alpha 1_{out}$(n), $\alpha 2_{out}$(n), and $\alpha 3_{out}$(n)) of the characteristic amounts of the image (output image) displayed on the liquid crystal panel 112.

As illustrated in FIGS. 8A, 8B, 8C, and 8D, "FIG. 8C the temporal change amount of the output image characteristic amount" is the temporal change amount corresponding to the output image corresponding to each of the three types of image characteristic amounts [FIG. 8A image characteristic amounts] calculated by the image characteristic amount calculation unit 101, that is, the change amount of the characteristic amounts ($\alpha$1out(n), $\alpha$2out(n), or $\alpha$3out(n)) of the two consecutive frames (frames n and n+1).

"(c) The temporal change amounts of the output image characteristic amounts" ($\alpha 1_{out}$(n), $\alpha 2_{out}$(n), and $\alpha 3_{out}$(n))" calculated by the drive voltage temporal change amount (light emission level temporal change amount) acquisition unit 104 are expressed by the following expressions (Expressions 2a to 2*c*).

[Math. 2]

$$\alpha 1_{out}(n) = \frac{\Delta Y_{frame(out)}(n+1)}{\Delta Y_{frame(out)}(n)} \quad \text{(Expression 2a)}$$

$$\alpha 2_{out}(n) = \frac{\Delta Y_{Line(out)}(n+1)}{\Delta Y_{Line(out)}(n)} \quad \text{(Expression 2b)}$$

$$\alpha 3_{out}(n) = \frac{\Delta MV_{frame(out)}(n+1)}{\Delta MV_{frame(out)}(n)} \quad \text{(Expression 2c)}$$

In this manner, the drive voltage temporal change amount (light emission level temporal change amount) acquisition unit 104 acquires the temporal change amounts of the characteristic amounts of the output image in the display device 110 of the input sample image 20, in other words, the temporal change amounts of the three types of image characteristic amounts acquired from the output image of the two consecutive frames (frames n and n+1).

The input/output image characteristic amount change rate calculation unit 103 inputs the respective data illustrated in FIGS. 8B and 8C and calculates the characteristic amount change rates ($\alpha1(n)$, $\alpha2(n)$, and $\alpha3(n)$) of the input/output image illustrated in FIG. 8D.

Specifically, the input/output image characteristic amount change rate calculation unit 103 calculates the characteristic amount change rates ($\alpha1(n)$, $\alpha2(n)$, and $\alpha3(n)$) of the input/output images illustrated in FIG. 8D, by inputting the temporal change amounts of the image characteristic amounts of the input/output images:

the temporal change amounts of the input image characteristic amounts in FIG. 8B, in other words, the characteristic amount temporal change amounts ($\alpha1in(n)$, $\alpha2in(n)$, and $\alpha3in(n)$) corresponding to the input image (input sample image) input from the image temporal change amount calculation unit 102; and the characteristic amount temporal change amounts corresponding to the output image (output sample image) in FIG. 8C, in other words, the characteristic amount temporal change amounts ($\alpha1out(n)$, $\alpha2out(n)$, and $\alpha3out(n)$) corresponding to the output image (output sample image) input from the drive voltage temporal change amount (light emission level temporal change amount) acquisition unit 104.

The characteristic amount change rates ($\alpha1$ (n), $\alpha2$ (n), and $\alpha3$ (n)) of the input/output images are expressed by the following expressions (Expressions 3a to 3c).

[Math. 3]

$$\alpha1(n) = \frac{\alpha1_{out}(n)}{\alpha1_{in}(n)} \quad \text{(Expression 3a)}$$

$$\alpha2(n) = \frac{\alpha2_{out}(n)}{\alpha2_{in}(n)} \quad \text{(Expression 3b)}$$

$$\alpha3(n) = \frac{\alpha3_{out}(n)}{\alpha3_{in}(n)} \quad \text{(Expression 3c)}$$

In this manner, the input/output image characteristic amount change rate calculation unit 103 inputs the temporal change amounts of the image characteristic amounts of the input/output images related to the sample image 20, and calculates the characteristic amount change rates ($\alpha1(n)$, $\alpha2(n)$, and $\alpha3(n)$) of the input/output images illustrated in FIG. 8D.

The calculated characteristic amount change rates ($\alpha1(n)$, $\alpha2(n)$, and $\alpha3(n)$) of the input/output images are stored in the storage unit (database) 150 as correspondence data to the data of the input image characteristic amounts.

"Correspondence data 120 between the input image characteristic amount and the characteristic amount change rate of the input/output images" which is "correspondence data 120 between the input image characteristic amount and the characteristic amount change rate of the input/output images" illustrated in FIG. 5 and is stored in the storage unit (database) 150, will be described with reference to FIGS. 9A and 9B.

FIGS. 9A and 9B illustrate only the following two data:

FIG. 9A the image characteristic amount; and

FIG. 9B the characteristic amount change rate of the input/output images, in the following data described with reference to FIGS. 8A, 8B, 8C, and 8D, in other words, the four data:

FIG. 8A the image characteristic amount;

FIG. 8B the temporal change amount of the input image characteristic amount;

FIG. 8C the temporal change amount of the output image characteristic amount; and FIG. 8D the characteristic amount change rate of the input/output images.

"FIG. 6A The image characteristic amount" refers to the three types of image characteristic amounts calculated from the input image (sample image 20) by the image characteristic amount calculation unit 101. As described with reference to FIGS. 6A and 6B, there are the following three types of characteristic amounts.

(1) An interframe luminance change amount: $\Delta$Yframe (in)(n)

(2) An interline luminance change amount: $\Delta$Yline(in)(n)

(3) An interframe motion vector: MVframe(in)(n)

"FIG. 9B The characteristic amount change rate of the input/output images" is a calculated value of input/output image characteristic amount change rate calculation unit 103. The input/output image characteristic amount change rate calculation unit 103 inputs the temporal change amounts of the image characteristic amounts of the input/output images related to the sample image 20, and calculates the characteristic amount change rates ($\alpha1(n)$, $\alpha2(n)$, and $\alpha3(n)$) of the input/output images illustrated in FIG. 9B.

The input/output image characteristic amount change rate calculation unit 103 generates correspondence data of the two data:

(a) the image characteristic amount; and (d) the characteristic amount change rate of the input/output images on a characteristic amount basis, and stores the correspondence data in the storage unit (database) 150.

Specifically, as illustrated in the lower graph in FIGS. 9A and 9B, the input/output image characteristic amount change rate calculation unit 103 generates three types of correspondence data:

(1) input/output image characteristic amount change rate data corresponding to the interframe luminance change amount;

(2) input/output image characteristic amount change rate data corresponding to the interline luminance change amount; and (3) input/output image characteristic amount change rate data corresponding to the interframe motion vector, and stores the data in the storage unit (database) 150.

The "(1) input/output image characteristic amount change rate data corresponding to the interframe luminance change amount" is correspondence data indicating a correspondence relationship between (1A) the interframe luminance change amount: $\Delta$Yframe (in)(n); and (1B) the characteristic amount (interframe luminance change amount) change rate of the input/output images: $\alpha1(n)$, as illustrated in FIGS. 9A and 9B.

The "(2) input/output image characteristic amount change rate data corresponding to the interline luminance change amount" is correspondence data indicating a correspondence relationship between (2A) the interline luminance change amount: ΔYline(in)(n); and (2B) the characteristic amount (interline luminance change amount) change rate of the input/output images: α2(n), as illustrated in FIGS. 9A and 9B.

The "(3) input/output image characteristic amount change rate data corresponding to the interframe motion vector" is correspondence data indicating a correspondence relationship between (3a) the interframe motion vector: MVframe(in)(n); and (3d) the characteristic amount (interframe motion vector) change rate of the input/output images: α3(n), as illustrated in FIGS. 9A and 9B.

The input/output image characteristic amount change rate calculation unit 103 thus generates correspondence data of the two data:

(a) the image characteristic amount; and (d) the characteristic amount change rate of the input/output images, for each of the three characteristic amounts, and stores the correspondence data in the storage unit (database) 150.

The data stored in the storage unit (database) 150 is data to be applied to the image correction processing in the online processing unit 200.

The offline processing unit 100 inputs the sample image 20 having various different characteristics, further inputs the output image data of the sample image displayed on the display device 110, analyzes characteristics of the input/output images, generates the data to be applied to the image correction processing in the online processing unit 200 on the basis of an analysis result, and accumulates the data in the storage unit (database) 150.

In other words, the offline processing unit 100 inputs various images having different image characteristic amounts:

(1) the interframe luminance change amount;

(2) the interline luminance change amount; and (3) the interframe motion vector, as the sample image, and generates the correspondence data of the two data:

FIG. 9A the characteristic amount; and

FIG. 9B the characteristic amount change rate of the input/output images, that is, the correspondence data illustrated as the three graphs in FIGS. 9A and 9B, for the three characteristic amounts, and stores the correspondence data in the storage unit (database) 150.

4. Configuration Example and Processing Example of Online Processing Unit

Next, a configuration and a processing example of the online processing unit 200 of the liquid crystal display apparatus 10 illustrated in FIG. 4 will be described.

The online processing unit 200 illustrated in FIG. 4 inputs the image to be corrected data 50, executes the image correction processing using the data stored in the storage unit (database) 150, and outputs the corrected image to the display device 110 to display the corrected image.

Note that the image correction processing in the online processing unit 200 is correction processing executed for the purpose of reducing flicker.

Figure 10:
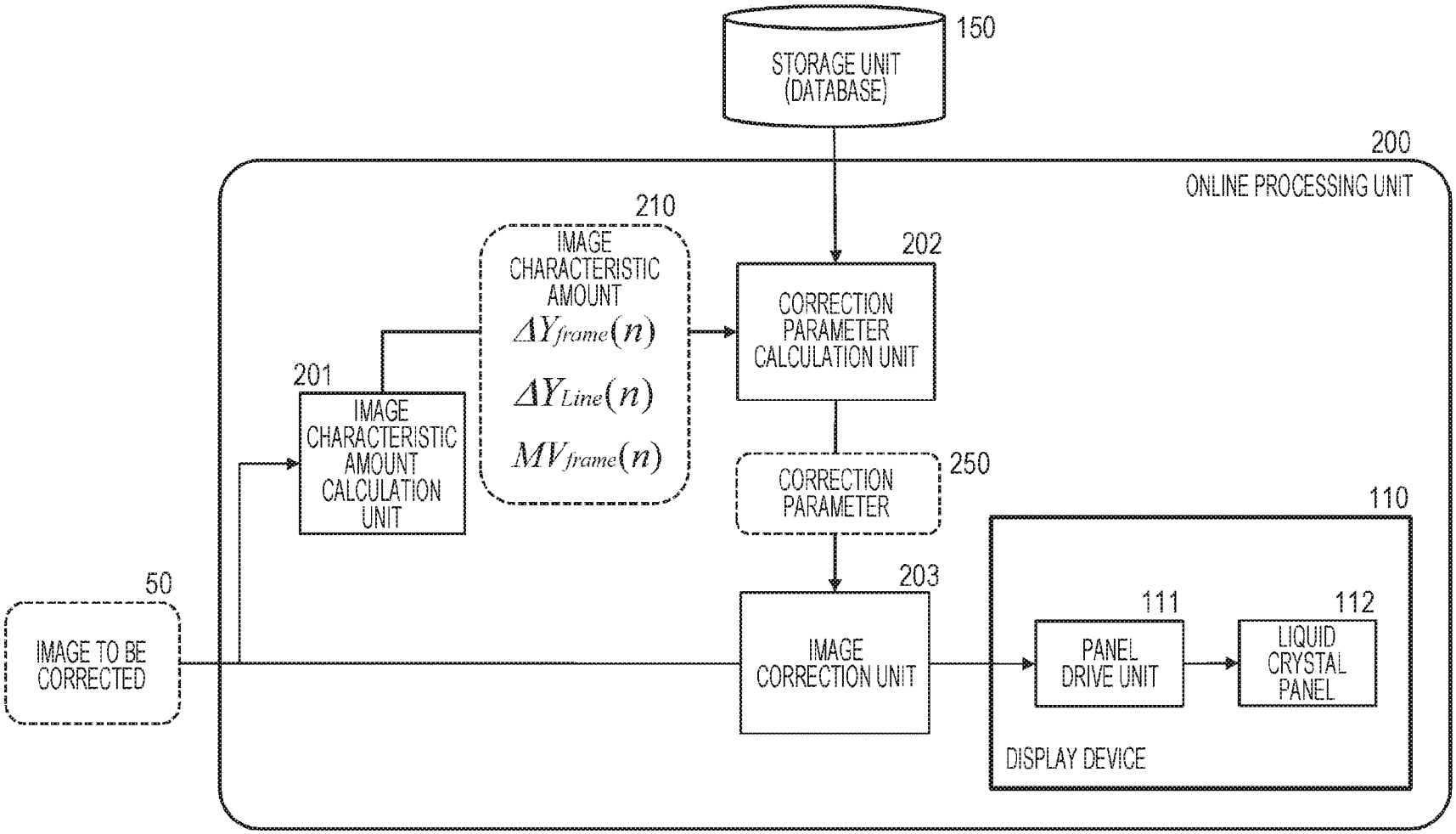
FIG. 10 is a block diagram illustrating a configuration example of an online processing unit of the liquid crystal display apparatus.

FIG. 10 is a block diagram illustrating a configuration example of the online processing unit 200 of the liquid crystal display apparatus 10 illustrated in FIG. 4.

As illustrated in FIG. 10, the online processing unit 200 includes an image characteristic amount calculation unit 201, a correction parameter calculation unit 202, and an image correction unit 203.

Note that FIG. 10 also illustrates the display device 110 including the panel drive unit 111 and the liquid crystal panel 112 as a constituent element of the online processing unit 200.

The display device 110 is the display device 110 illustrated in FIG. 4 and is a display device commonly used both in the processing of the offline processing unit 100 and the processing of the online processing unit 200.

As described above, the display device 110 is an independent element and is also a constituent element of the offline processing unit 100 and of the online processing unit 200.

Processing executed by the online processing unit 200 illustrated in FIG. 10 will be described.

The image characteristic amount calculation unit 201 inputs the image to be corrected 50, analyzes the input image to be corrected 50, and calculates various characteristic amounts from each image to be corrected.

The characteristic amount acquired from the image to be corrected 50 by the image characteristic amount calculation unit 201 is the same type of characteristic amount as the characteristic amount acquired by the image characteristic amount calculation unit 101 of the offline processing unit 100 described with reference to FIGS. 6A and 6B and the like.

In other words, the image characteristic amount calculation unit 201 acquires the following image characteristic amounts from the image to be corrected 50.

(1) An interframe luminance change amount: $\Delta Y_{frame}$ (n)

(2) An interline luminance change amount: $\Delta Y_{line}$(n)

(3) An interframe motion vector: $MV_{frame}$ (n)

"(1) The interframe luminance change amount: $\Delta Y_{frame}$ (n)" is a difference in image frame average luminance between two consecutive image frames.

"(2) The interline luminance change amount: $\Delta Y_{line}$(n)" is a difference in pixel line average luminance between adjacent pixel lines in one image frame.

Note that the interline luminance change amount is calculated for each of a horizontal line and a vertical line.

"(3) The interframe motion vector: $MV_{frame(in)}$ (n)" is a motion vector indicating a motion amount between frames calculated from two consecutive image frames.

The image characteristic amount calculation unit 201 calculates these three types of image characteristic amounts, in other words, image characteristic amounts 210 illustrated in FIG. 10, and inputs the calculated image characteristic amounts 210 to the correction parameter calculation unit 202, for example.

The correction parameter calculation unit 202 inputs the image characteristic amounts 210, in other words, the following image characteristic amounts of the image to be corrected 50 from the image characteristic amount calculation unit 201.

(1) An interframe luminance change amount: $\Delta Y_{frame}$ (n)

(2) An interline luminance change amount: $\Delta Y_{line}$ (n)

(3) An interframe motion vector: $MV_{frame}$ (n)

Moreover, the correction parameter calculation unit 202 inputs the following data described with reference to FIGS. 9A and 9B, in other words:

(1) the input/output image characteristic amount change rate data corresponding to the interframe luminance change amount;

(2) the input/output image characteristic amount change rate data corresponding to the interline luminance change amount; and (3) the input/output image characteristic amount change rate data corresponding to the interframe motion vector, from the storage unit (database) 150, and inputs the database storage data.

The correction parameter calculation unit 202 calculates a correction parameter 250 for reducing flicker of the image to be corrected 50, using the input data, and outputs the calculated correction parameter 250 to the image correction unit 203.

A specific example of correction parameter calculation processing executed by the correction parameter calculation unit 202 will be described with reference to FIGS. 11A, 11B, and 11C.

FIGS. 11A, 11B, and 11C illustrate the following data.

FIG. 11A Storage data in the storage unit (database) 150

FIG. 11B The characteristic amounts acquired from the image to be corrected 50 by the image characteristic amount calculation unit 201

FIG. 11C The correction parameters calculated by the correction parameter calculation unit 202

FIG. 9A The storage data of the storage unit (database) 150 is the following data described with reference to FIGS. 9A and 9B, in other words:

(A1) the input/output image characteristic amount change rate data corresponding to the interframe luminance change amount;

(A2) the input/output image characteristic amount change rate data corresponding to the interline luminance change amount; and (A3) the input/output image characteristic amount change rate data corresponding to the interframe motion vector.

(B) The characteristic amounts acquired from the image to be corrected 50 by the image characteristic amount calculation unit 201 are the following image characteristic amounts.

(B1) An interframe luminance change amount: $\Delta Y_{frame}$ (n)

(B2) An interline luminance change amount: $\Delta Y_{line}$(n)

(B3) An interline luminance change amount: $MV_{frame}$(n)

The correction parameter calculation unit 202 calculates one parameter in the correction parameters illustrated in FIG. 11C, in other words, (C1) a temporal direction smoothing coefficient (Ft)

on the basis of the two data:

"(A1) the input/output image characteristic amount change rate data corresponding to the interframe luminance change amount" stored in the storage unit (database) 150; and "(B1) the interframe luminance change amount: ΔYframe (n)211" acquired from the image to be corrected 50 by the image characteristic amount calculation unit 201.

Note that FIG. 11C illustrates a graph in which the interframe luminance change amount: ΔYframe(n) is set on the horizontal axis and the temporal direction smoothing coefficient (Ft) is set on the vertical axis, as (C1) the temporal direction smoothing coefficient (Ft).

This graph is data generated on the basis of the correspondence relationship data:

the storage data in the storage unit (database) 150 illustrated in FIG. 11A, in other words, "(A1) the input/output image characteristic amount change rate data corresponding to the interframe luminance change amount"; and the interframe luminance change amount of the sample image: ΔYframe(in)(n) on the horizontal axis, and the characteristic amount (interframe luminance change amount) change rate of the input/output images: α1 on the vertical axis.

(C1) The temporal direction smoothing coefficient (Ft) is generated by replacing the interframe luminance change amount: $\Delta Y_{frame(in)}$ (n) of the sample image on the horizontal axis of the storage data in the storage unit (database) 150, in other words, (A1) the input/output image characteristic amount change rate data corresponding to the interframe luminance change amount with the image characteristic amount acquired from the image to be corrected 50 by the image characteristic amount calculation unit 201, (B1) the interframe luminance change amount: $\Delta Y_{frame}$ (n), and by further replacing α1 on the vertical axis with the temporal direction smoothing coefficient (Ft).

Note that the temporal direction smoothing coefficient (Ft) on the vertical axis may be set to $$Ft=\alpha 1.$$

However, the temporal direction smoothing coefficient (Ft) calculated according to the following calculation expression $$Ft=k\cdot\alpha 1,$$

using a predefined multiplication parameter k, may be set on the vertical axis.

The correction parameter calculation unit 202 calculates one temporal direction smoothing coefficient (Ft), using the correspondence relationship data (graph) illustrated in FIG. 11C(C1), and outputs the temporal direction smoothing coefficient (Ft) to the image correction unit 203.

This processing will be described with reference to FIGS. 12B and 12C.

Figures 12B, 12C:
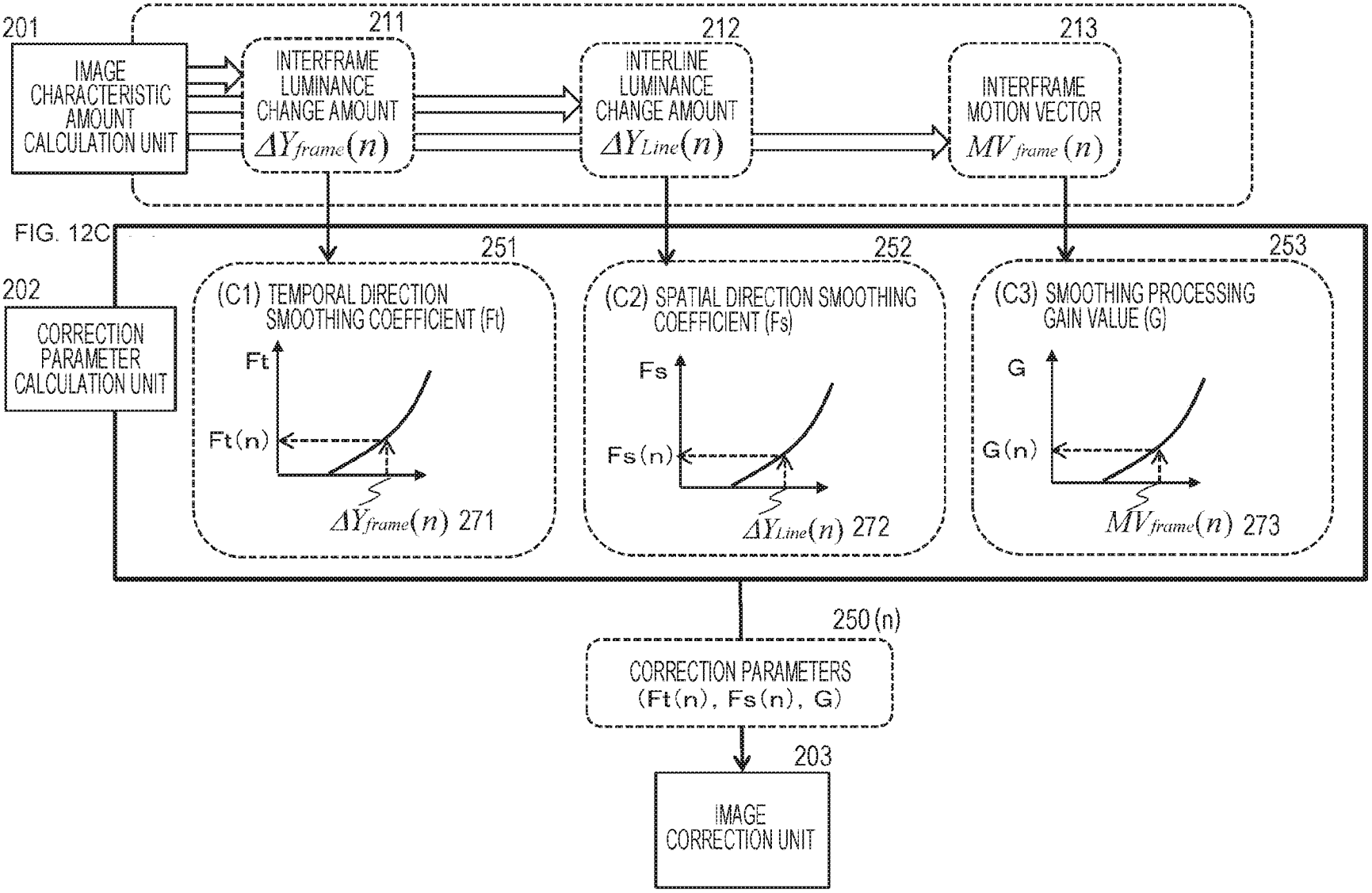
FIGS. 12B and 12C are diagrams for describing a specific example of correction parameter calculation processing executed by a correction parameter calculation unit.

Assuming that the following image characteristic amount acquired from the frame n of the image to be corrected 50 by the image characteristic amount calculation unit 201:

(B1) the interframe luminance change amount: ΔYframe (n)

is ΔYframe(n)271 on the horizontal axis of the graph (C1) in FIG. 12C.

The correction parameter calculation unit 202 obtains the temporal direction smoothing coefficient (Ft) corresponding to ΔYframe(n)271 according to the curve of the graph (C1) in FIG. 12C.

In the example in FIG. 12C, (Ft(n)) is calculated as the temporal direction smoothing coefficient (Ft) to be applied to the frame n.

The correction parameter calculation unit 202 outputs the temporal direction smoothing coefficient (Ft(n)) to the image correction unit 203 as the temporal direction smoothing coefficient (Ft) to be applied to the frame n.

The temporal direction smoothing coefficient (Ft(n)) is one correction parameter corresponding to the frame included in the correction parameter 250(*n*) illustrated in FIGS. 12B and 12C.

Referring back to FIGS. 11A, 11B, and 11C, the description of the processing by the correction parameter calculation unit 202 will be continued.

Moreover, the correction parameter calculation unit 202 calculates one parameter in the correction parameters illustrated in FIG. 11C, in other words, (C2) a spatial direction smoothing coefficient (Fs)

on the basis of the two data:

"(A2) the input/output image characteristic amount change rate data corresponding to the interline luminance change amount" stored in the storage unit (database) 150 illustrated in FIG. 11A; and "(B2) the interline luminance change amount: ΔYline(n) 212" acquired from the image to be corrected 50 by the image characteristic amount calculation unit 201.

Note that FIG. 11C illustrates a graph in which the interframe luminance change amount: ΔYline(n) is set on the horizontal axis and the spatial direction smoothing coefficient (Fs) is set on the vertical axis, as (C2) the spatial direction smoothing coefficient (Fs).

This graph is data generated on the basis of the correspondence relationship data:

the storage data in the storage unit (database) 150 illustrated in FIG. 11A, in other words, "(A2) the input/output image characteristic amount change rate data corresponding to the interline luminance change amount"; and the interline luminance change amount of the sample image: ΔYline(in)(n) on the horizontal axis, and the characteristic amount (interline luminance change amount) change rate of the input/output images: α2 on the vertical axis.

(C2) The spatial direction smoothing coefficient (Fs) is generated by replacing the interframe luminance change amount: $\Delta Y_{line(in)}$ (n) of the sample image on the horizontal axis of the storage data in the storage unit (database) 150, in other words, (A2) the input/output image characteristic amount change rate data corresponding to the interline luminance change amount with the image characteristic amount acquired from the image to be corrected 50 by the image characteristic amount calculation unit 201, (B2) the interline luminance change amount: $\Delta Y_{line}$ (n), and by further replacing α2 on the vertical axis with the spatial direction smoothing coefficient (Fs).

Note that the spatial direction smoothing coefficient (Fs) on the vertical axis may be set to $$Fs=\alpha 2.$$

However, the spatial direction smoothing coefficient (Fs) calculated according to the following calculation expression $$Fs=k\cdot\alpha 2,$$

using a predefined multiplication parameter k, may be set on the vertical axis.

The correction parameter calculation unit 202 calculates the one spatial direction smoothing coefficient (Fs), using the correspondence relationship data (graph) illustrated in FIG. 11C(C2), and outputs the spatial direction smoothing coefficient (Fs) to the image correction unit 203.

This processing will be described with reference to FIGS. 12B and 12C.

Assuming that the following image characteristic amount acquired from the frame n of the image to be corrected 50 by the image characteristic amount calculation unit 201:

(B2) the interline luminance change amount: ΔYline(n)

is ΔYline(n)272 on the horizontal axis of the graph (C2) in FIG. 12C(C). The correction parameter calculation unit 202 obtains the spatial direction smoothing coefficient (Fs) corresponding to ΔYline(n)272 according to the curve of the graph (C2) in FIG. 12C.

In the example in FIG. 12C, (Fs(n)) is calculated as the spatial direction smoothing coefficient (Fs) to be applied to the frame n.

The correction parameter calculation unit 202 outputs the spatial direction smoothing coefficient (Fs(n)) to the image correction unit 203 as the spatial direction smoothing coefficient (Fs) to be applied to the frame n.

The temporal direction smoothing coefficient (Fs(n)) is one correction parameter corresponding to the frame included in the correction parameter 250(*n*) illustrated in FIGS. 12B and 12C.

Referring back to FIGS. 11A, 11B, and 11C, the description of the processing by the correction parameter calculation unit 202 will be continued.

Moreover, the correction parameter calculation unit 202 calculates one parameter in the correction parameters illustrated in FIG. 11C, in other words, (C3) a smoothing processing gain value (G) on the basis of the two data: "(A3) the input/output image characteristic amount change rate data corresponding to the interframe motion vector" stored in the storage unit (database) 150; and "(B3) the interframe motion vector: MVframe(n)213" acquired from the image to be corrected 50 by the image characteristic amount calculation unit 201.

Note that FIG. 11C illustrates a graph in which the interframe motion vector: MVframe(n) is set on the horizontal axis and the smoothing processing gain value (G) is set on the vertical axis, as (C3) the smoothing processing gain value (G).

This graph is data generated on the basis of the correspondence relationship data:

the storage data in the storage unit (database) 150 illustrated in FIG. 11A, in other words, (A3) the input/output image characteristic amount change rate data corresponding to the interframe motion vector; and the interframe motion vector of the sample image: MVframe(in)(n) on the horizontal axis, and the characteristic amount (interframe motion vector) change rate of the input/output images: α3 on the vertical axis.

(C3) The smoothing processing gain value (G) is generated by replacing the interframe motion vector: $MV_{frame(in)}$ (n) of the sample image on the horizontal axis of the storage data in the storage unit (database) 150, in other words, (A3) the input/output image characteristic amount change rate data corresponding to the interframe motion vector with the image characteristic amount acquired from the image to be corrected 50 by the image characteristic amount calculation unit 201, (B3) the interframe motion vector: $MV_{frame}$ (n), and by further replacing α3 on the vertical axis with the smoothing processing gain value (G).

Note that the smoothing processing gain value (G) on the vertical axis may be set to $$G=\alpha 3.$$

However, the smoothing processing gain value (G) calculated according to the following calculation expression $$G=k\cdot\alpha 3,$$

using a predefined multiplication parameter k, may be set on the vertical axis.

The correction parameter calculation unit 202 calculates the one smoothing processing gain value (G), using the correspondence relationship data (graph) illustrated in FIG.

11C(C3), and outputs the smoothing processing gain value (G) to the image correction unit 203.

This processing will be described with reference to FIGS. 12B and 12C.

Assuming that the following image characteristic amount acquired from the frame n of the image to be corrected 50 by the image characteristic amount calculation unit 201:

(B3) the interframe motion vector: MVframe(n)

is ΔMVframe(n)273 on the horizontal axis of the graph (C3) in FIG. 12C.

The correction parameter calculation unit 202 obtains the smoothing processing gain value (G) corresponding to ΔMVframe(n)273 according to the curve of the graph (C3) in FIG. 12C.

In the example in FIG. 12C, (G(n)) is calculated as the smoothing processing gain value (G) to be applied to the frame n.

The correction parameter calculation unit 202 outputs the smoothing processing gain value (G(n)) to the image correction unit 203 as the smoothing processing gain value (G) to be applied to the frame n.

The smoothing processing gain value (G(n)) is one correction parameter corresponding to the frame included in the correction parameter 250(*n*) illustrated in FIGS. 12B and 12C.

In this manner, the correction parameter calculation unit 202 inputs the data:

(1) the input/output image characteristic amount change rate data corresponding to the interframe luminance change amount;

(2) the input/output image characteristic amount change rate data corresponding to the interline luminance change amount; and (3) the input/output image characteristic amount change rate data corresponding to the interframe motion vector, from the storage unit (database) 150, and inputs the following image characteristic amounts of the image to be corrected 50 from the image characteristic amount calculation unit 201.

(1) An interframe luminance change amount: $\Delta Y_{frame}$ (n)

(2) An interline luminance change amount: $\Delta Y_{line}$(n)

(3) An interframe motion vector: $MV_{frame}$ (n)

The correction parameter calculation unit 202 calculates the following image correction parameters illustrated in FIG. 12C, in other words:

(C1) the temporal direction smoothing coefficient (Ft);

(C2) the spatial direction smoothing coefficient (Fs); and (C3) the smoothing processing gain value (G)

on the basis of the input data.

The above three types of image correction parameters 250 calculated by the correction parameter calculation unit 202 are input to the image correction unit 203 of the online processing unit 200 illustrated in FIG. 10.

The image correction unit 203 executes the image correction processing for the image to be corrected 50, applying the following correction parameters 250 input from the correction parameter calculation unit 202.

(C1) The temporal direction smoothing coefficient (Ft)

(C2) The spatial direction smoothing coefficient (Fs)

(C3) The smoothing processing gain value (G)

The corrected image to which the above correction parameters have been applied and corrected is output to the display device 110 and displayed.

The correction parameters (C1) to (C3) are correction parameters that produce the flicker reduction effect, and are correction parameters that reflect the characteristics of the input image and the display device output characteristics.

Therefore, optimum flicker reduction processing according to characteristics of an image and characteristics of a display device becomes possible by the image correction to which the correction parameters are applied.

5. Sequence of Processing Executed by Liquid Crystal Display Apparatus

Next, a sequence of processing executed by the liquid crystal display apparatus will be described.

Sequences of processing executed by the liquid crystal display apparatus will be described with reference to the flowcharts illustrated in FIGS. 13 to 16.

The flowcharts illustrated in FIGS. 13 to 16 are flowcharts for describing the following processing sequences, respectively.

Figure 13:
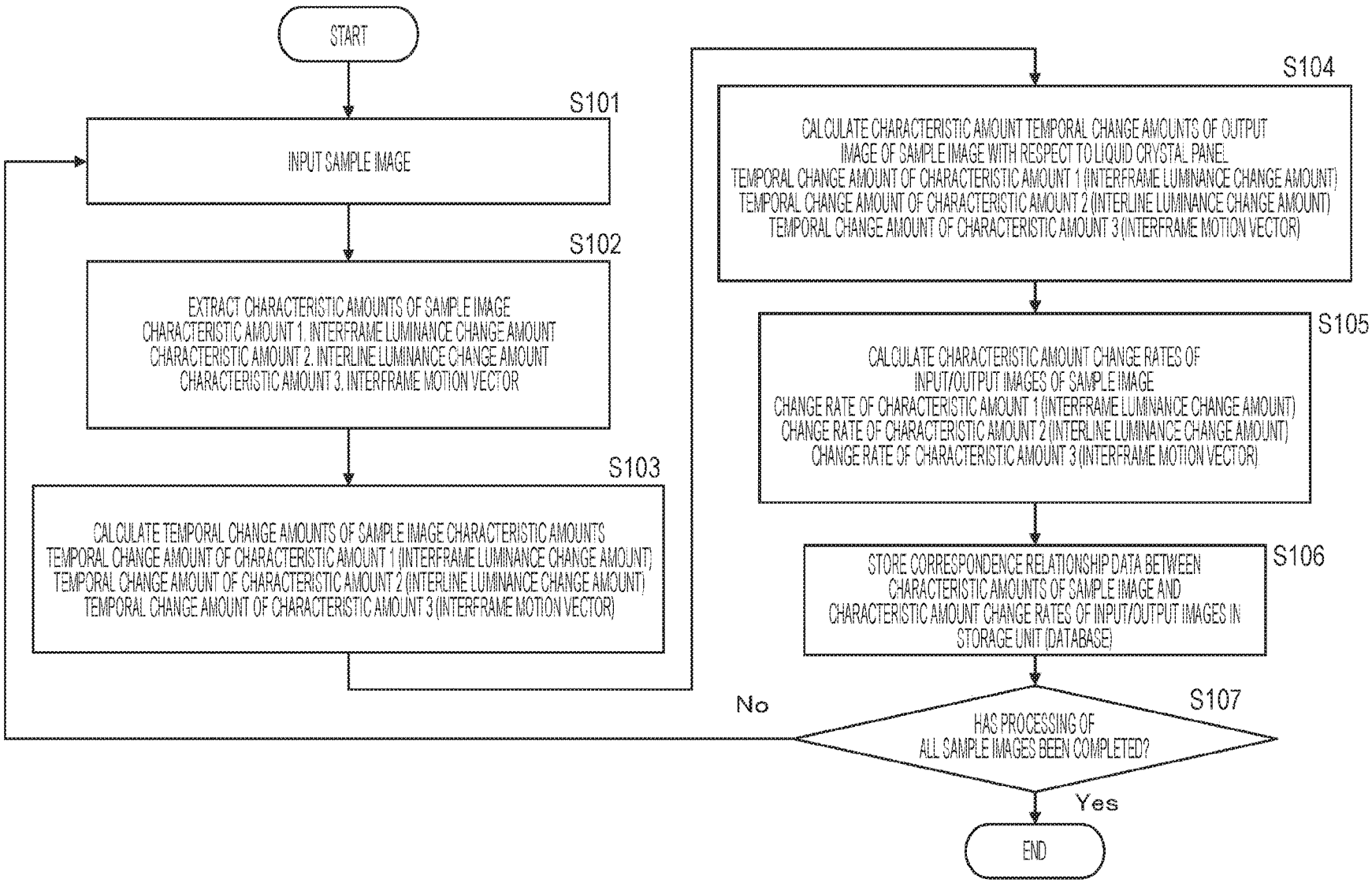
FIG. 13 is a flowchart for describing a sequence of processing executed by the liquid crystal display apparatus of the present disclosure.

(1) FIG. 13 is a flowchart for describing a sequence of processing executed by the offline processing unit 100.

Figure 14:
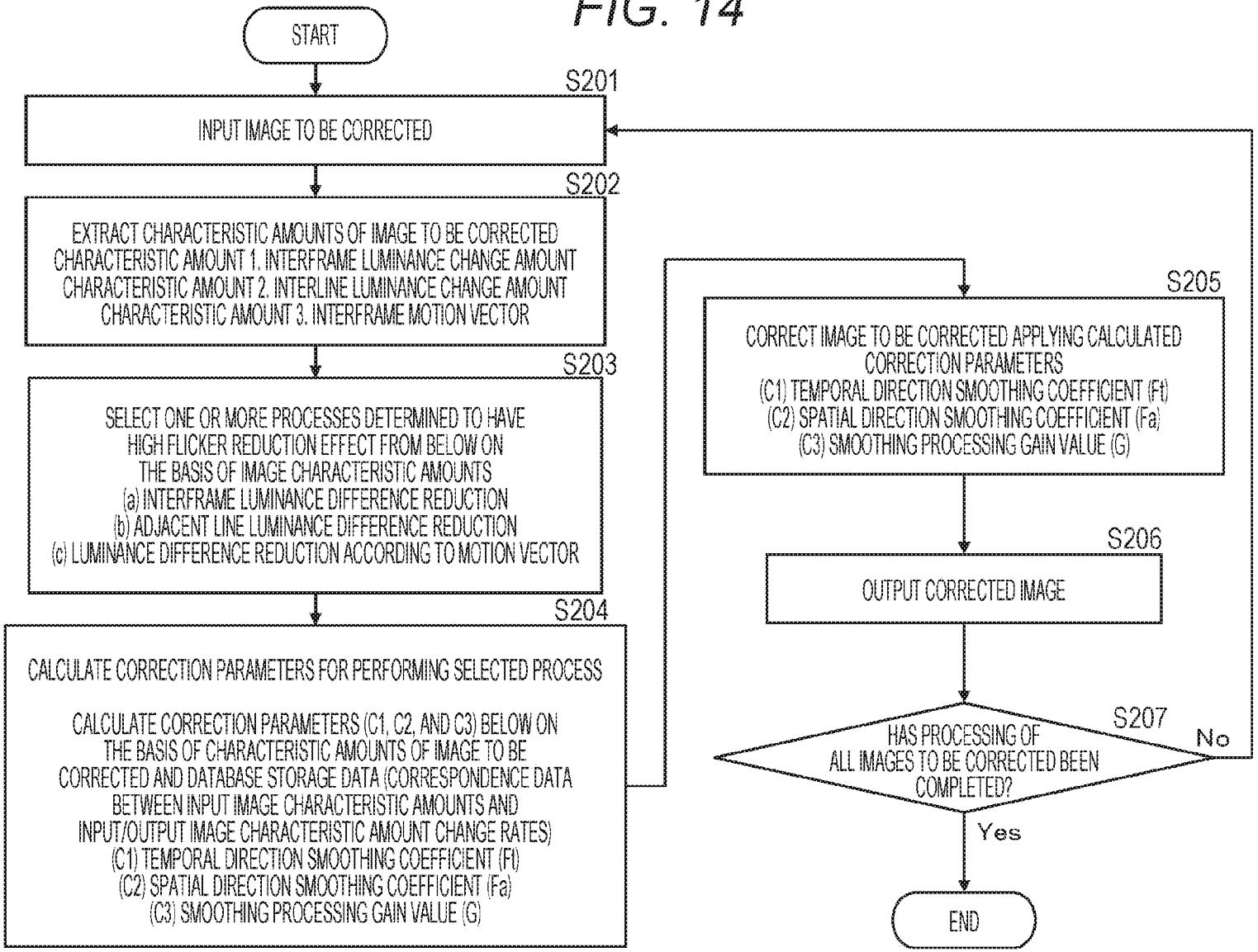
FIG. 14 is a flowchart for describing a sequence of processing executed by the liquid crystal display apparatus of the present disclosure.

(2) FIG. 14 is a flowchart for describing a sequence of the processing example 1 executed by the online processing unit 200.

Figure 15:
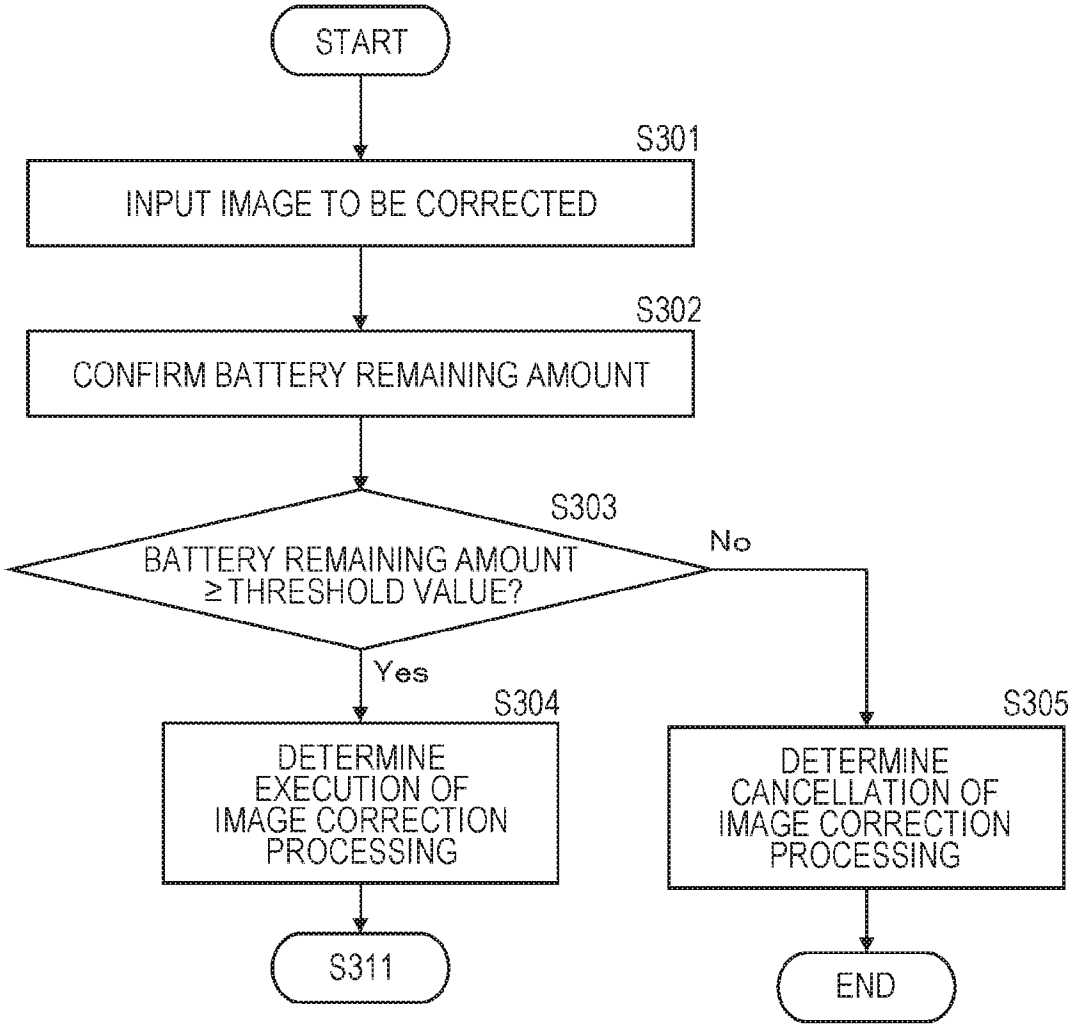
FIG. 15 is a flowchart for describing a sequence of processing executed by the liquid crystal display apparatus of the present disclosure.
Figure 16:
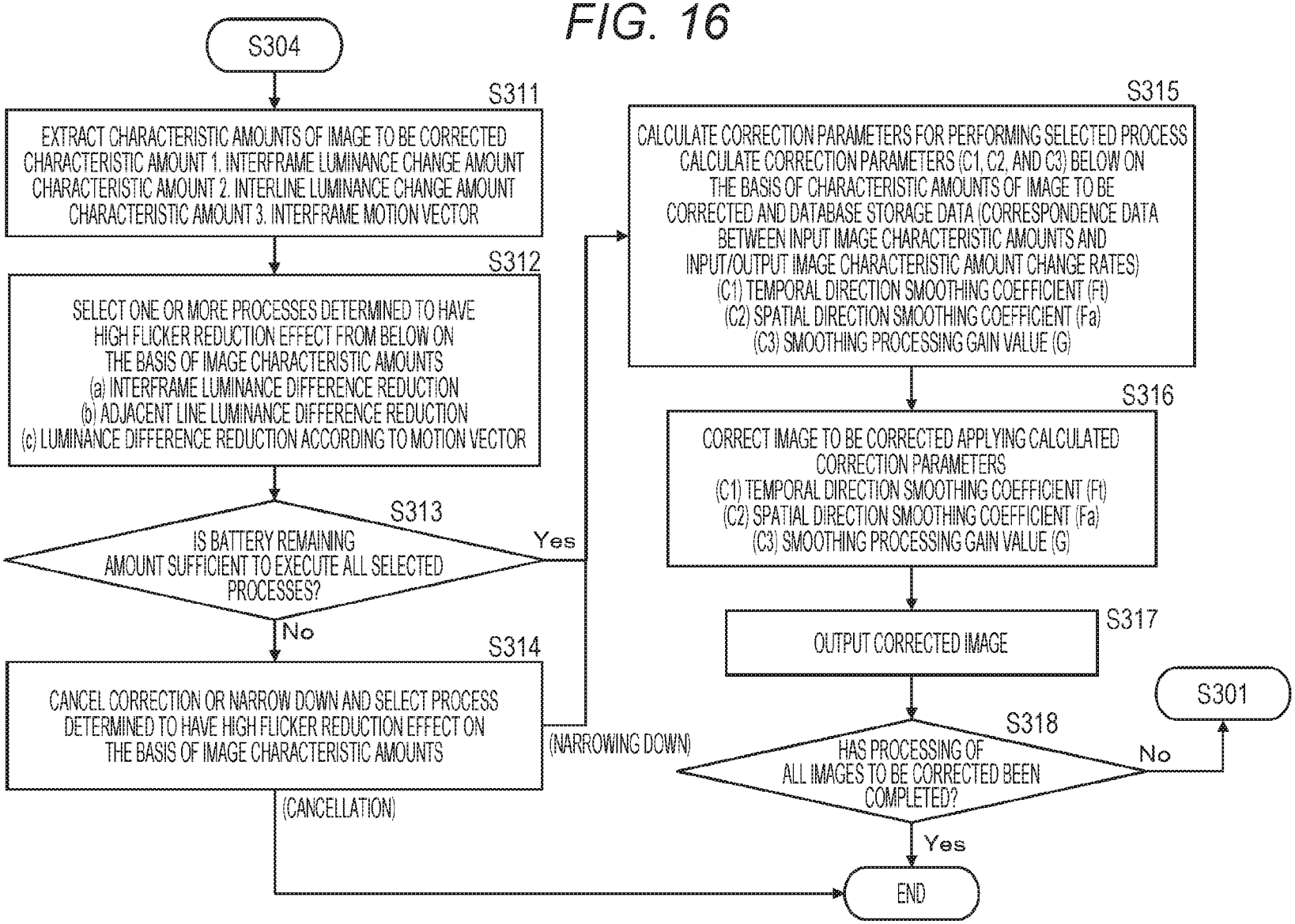
FIG. 16 is a flowchart for describing a sequence of processing executed by the liquid crystal display apparatus of the present disclosure.

(3) FIGS. 15 and 16 are flowcharts for describing a sequence of the processing example 2 executed by the online processing unit 200.

Hereinafter, each processing sequence will be described according to each flow.

5-1. Sequence of Processing Executed by Offline Processing Unit

First, the sequence of the processing executed by the offline processing unit 100 will be described with reference to the flowchart illustrated in FIG. 13.

First, as described with reference to FIGS. 4 and 5, and the like, the offline processing unit 100 inputs the sample image 20 having various different characteristics, generates the data to be applied to the image correction processing in the online processing unit 200, and accumulates the data in the storage unit (database) 150.

Note that the processing according to the flowchart illustrated in FIG. 13 is not illustrated in FIGS. 4 and 5, for example. However, the processing can be executed under control of the control unit (data processing unit) configured by a CPU and the like having a program execution function according to the program stored in the storage unit of the liquid crystal display apparatus.

Hereinafter, the processing of each step of the flowchart illustrated in FIG. 13 will be sequentially described.

(Step S101)

First, in step S101, the offline processing unit 100 inputs the sample image.

(Step S102)

Next, in step S102, the offline processing unit 100 extracts the characteristic amounts of the sample image.

This processing is the processing executed by the image characteristic amount calculation unit 101 of the offline processing unit 100 illustrated in FIG. 5.

As described with reference to FIGS. 6A and 6B, the image characteristic amount calculation unit 101 acquires the following image characteristic amounts from the sample image 20.

(1) An interframe luminance change amount: ΔYframe (in)(n)

(2) An interline luminance change amount: ΔYline(in)(n)

(3) An interframe motion vector: MVframe(in)(n)

(Step S103)

Next, in step S103, the offline processing unit 100 calculates the temporal change amounts of the sample image characteristic amounts.

This processing is the processing executed by the image temporal change amount calculation unit 102 of the offline processing unit 100 illustrated in FIG. 5.

The image temporal change amount calculation unit 102 acquires the temporal change amounts of the following image characteristic amounts acquired from the two consecutive frames (frames n and n+1) input as the sample image 20.

(1) The temporal change amount of the interframe luminance change amount: $\alpha 1in(n)$ (2) The temporal change amount of the interline luminance change amount: $\alpha 2in(n)$ (3) The temporal change amount of the interframe motion vector: $\alpha 3in(n)$ The temporal change amounts [$\alpha 1in(n)$, $\alpha 2in(n)$, and $\alpha 3in(n)$] of the image characteristic amounts are the data described with reference to FIGS. 7A and 7B.

(Step S104)

Next, in step S104, the offline processing unit 100 calculates the characteristic amount temporal change amounts of the output image to be output to the liquid crystal panel on the basis of the input sample image.

This processing is the processing executed by the drive voltage temporal change amount (light emission level temporal change amount) acquisition unit 104 of the offline processing unit 100 illustrated in FIG. 5.

The drive voltage temporal change amount (light emission level temporal change amount) acquisition unit 104 of the offline processing unit 100 illustrated in FIG. 5 acquires the temporal change amount of the drive voltage of the sample image 20 displayed on the display device 110. The drive voltage corresponds to the cell voltage described with reference to FIG. 1B, for example, and corresponds to the luminance of each pixel.

In other words, the drive voltage temporal change amount (light emission level temporal change amount) acquisition unit 104 calculates the temporal change amounts ($\alpha 1out(n)$, $\alpha 2out(n)$, and $\alpha 3out(n)$) of the characteristic amounts of the image (output image) displayed on the liquid crystal panel 112.

This data is the data illustrated in FIG. 8C.

(Step S105)

Next, in step S105, the offline processing unit 100 calculates the characteristic amount change rates of the input/output image of the sample image.

This processing is the processing executed by the input/output image characteristic amount change rate calculation unit 103 of the offline processing unit 100 illustrated in FIG. 5.

The input/output image characteristic amount change rate calculation unit 103 calculates characteristic amount change rates ($\alpha 1$ (n), $\alpha 2$ (n), and $\alpha 3$ (n)) of the input/output images by inputting the characteristic amount temporal change amounts ($\alpha 1_{in}$ (n), $\alpha 2_{in}(n)$, and $\alpha 3_{in}(n)$) corresponding to the input image (input sample image) input from the image temporal change amount calculation unit 102, the characteristic amount temporal change amounts ($\alpha 1_{out}$ (n), $\alpha 2_{out}(n)$, and $\alpha 3_{out}(n)$) corresponding to the output image (output sample image) input from the drive voltage temporal change amount (light emission level temporal change amount) acquisition unit 104, and the temporal change amounts of the image characteristic amounts of each of the input/output images.

The characteristic amount change rates ($\alpha 1(n)$, $\alpha 2(n)$, and $\alpha 3(n)$) of the input/output image calculated by the input/output image characteristic amount change rate calculation unit 103 are the characteristic amount change rate data of the input/output images illustrated in FIG. 8D.

(Step S106)

Next, in step S106, the offline processing unit 100 stores the correspondence relationship data between the characteristic amounts of the sample image and the characteristic amount change rates of the input/output images in the storage unit (database).

This processing is the processing executed by the input/output image characteristic amount change rate calculation unit 103 of the offline processing unit 100 illustrated in FIG. 5.

This processing is the processing described with reference to FIGS. 9A and 9B. The input/output image characteristic amount change rate calculation unit 103 generates correspondence data of the two data:

FIG. 9A the image characteristic amount; and

FIG. 9B the characteristic amount change rate of the input/output images on a characteristic amount basis, and stores the correspondence data in the storage unit (database) 150.

Specifically, as illustrated in the lower graph in FIGS. 9A and 9B, the input/output image characteristic amount change rate calculation unit 103 generates three types of correspondence data:

(1) input/output image characteristic amount change rate data corresponding to the interframe luminance change amount;

(2) input/output image characteristic amount change rate data corresponding to the interline luminance change amount; and (3) input/output image characteristic amount change rate data corresponding to the interframe motion vector, and stores the data in the storage unit (database) 150.

(Step S107)

Next, in step S107, the offline processing unit 100 determines whether the processing for all the sample images has been completed.

In the case where there is an unprocessed sample image, the processing of step S101 and the following steps is executed for the unprocessed image.

In a case where the processing for all the sample images has been completed, the processing is terminated.

The offline processing unit 100 inputs the sample image 20 having various different characteristics, further inputs the output image data of the sample image displayed on the display device 110, analyzes characteristics of the input/output images, generates the data to be applied to the image correction processing in the online processing unit 200 on the basis of an analysis result, and accumulates the data in the storage unit (database) 150, according to the flow illustrated in FIG. 13.

5-2. Sequence of Processing Example 1 Executed by Online Processing Unit

Next, the sequence of the processing example 1 executed by the online processing unit 200 will be described with reference to the flowchart illustrated in FIG. 14.

As described with reference to FIGS. 4 and 10, and the like, the online processing unit 200 illustrated in FIG. 4 inputs the image to be corrected data 50, executes the image correction processing using the data stored in the storage unit (database) 150, and outputs the corrected image to the display device 110 to display the corrected image.

Note that the image correction processing in the online processing unit 200 is correction processing executed for the purpose of reducing flicker.

Note that the processing according to the flowchart illustrated in FIG. 14 is not illustrated in FIGS. 4 and 10, for example. However, the processing can be executed under control of the control unit (data processing unit) configured by a CPU and the like having a program execution function according to the program stored in the storage unit of the liquid crystal display apparatus.

Hereinafter, the processing of each step of the flowchart illustrated in FIG. 14 will be sequentially described.

(Step S201)

First, in step S201, the online processing unit 200 inputs the image to be corrected.

(Step S202)

Next, in step S202, the online processing unit 200 extracts the characteristic amounts of the image to be corrected.

This processing is the processing executed by the image characteristic amount calculation unit 201 of the online processing unit 200 illustrated in FIG. 10.

The image characteristic amount calculation unit 201 acquires the following image characteristic amounts from the image to be corrected W50.

(1) An interframe luminance change amount: $\Delta Y_{frame}$ (n)

(2) An interline luminance change amount: $\Delta Y_{line}$(n)

(3) An interframe motion vector: $MV_{frame}$ (n)

"(1) The interframe luminance change amount: $\Delta Y_{frame}$ (n)" is a difference in image frame average luminance between two consecutive image frames.

"(2) The interline luminance change amount: $\Delta Y_{line}$(n)" is a difference in pixel line average luminance between adjacent pixel lines in one image frame.

Note that the interline luminance change amount is calculated for each of a horizontal line and a vertical line.

"(3) The interframe motion vector: $MV_{frame(in)}$ (n)" is a motion vector indicating a motion amount between frames calculated from two consecutive image frames.

The image characteristic amount calculation unit 201 calculates these three types of image characteristic amounts, in other words, image characteristic amounts 210 illustrated in FIG. 10, and inputs the calculated image characteristic amounts 210 to the correction parameter calculation unit 202, for example.

(Step S203)

Next, in step S203, the online processing unit 200 selects one or more processing determined to have a high flicker reduction effect from the following processing on the basis of the image characteristic amounts extracted in step S202.

(a) Interframe luminance difference reduction processing (b) Interline luminance difference reduction processing (c) Luminance difference reduction processing according to a motion vector For example, in step S202, the following characteristic amounts extracted from the image to be corrected, in other words:

(1) the interframe luminance change amount: $\Delta Y_{frame}$(n);

(2) the interline luminance change amount: $\Delta Y_{line}$ (n); and (3) the interframe motion vector: $MV_{frame}$ (n)

and predefined threshold values Th1 to Th3 are compared. When the above characteristic amounts are equal to or larger than the threshold values, it is determined that there is the flicker reduction effect by the processing (a) to (c).

Specifically, for example, the following determination processing is performed.

In the case where (Determination Expression 1) the interframe luminance change amount: $\Delta Y_{frame}$ (n)≥Th1 is satisfied, it is determined that there is the flicker reduction effect by (a) the interframe luminance difference reduction processing.

Furthermore, in the case where (Determination Expression 2) the interline luminance change amount: $\Delta Y_{line}$ (n)≥Th2 is satisfied, it is determined that there is the flicker reduction effect by (b) the interline luminance difference reduction processing.

Furthermore, in the case where (Determination Expression 3) the interframe motion vector: $MV_{frame}$(n)≥Th3 is satisfied, it is determined that there is the flicker reduction effect by (c) the luminance difference reduction processing according to a motion vector.

Note that these determination processes can be performed on a pixel basis of the image to be corrected or on a pixel region basis configured by a plurality of pixels.

As described above, in step S203, the online processing unit 200 selects one or more processing determined to have a high flicker reduction effect from the following processing on the basis of the image characteristic amounts extracted in step S202.

(a) Interframe luminance difference reduction processing (b) Interline luminance difference reduction processing (c) Luminance difference reduction processing according to a motion vector (Step S204)

Next, in step S204, the online processing unit 200 calculates the correction parameter to be applied to execute the processing selected from below as the processing having the flicker reduction effect in step S203, in other words:

(a) the interframe luminance difference reduction processing;

(b) the interline luminance difference reduction processing; and (c) the luminance difference reduction processing according to a motion vector.

This processing is the processing executed by the correction parameter calculation unit 202 of the online processing unit 200 illustrated in FIG. 10.

Note that the calculation of the correction parameter is executed on a region basis, the region being targeted for flicker reduction effect existence determination processing in step S203. In other words, the processing is executed on a pixel basis of the image to be corrected or on a pixel region basis configured by a plurality of pixels.

The correction parameter calculation unit 202 inputs the following image characteristic amounts of the image to be corrected 50 from the image characteristic amount calculation unit 201.

(1) An interframe luminance change amount: $\Delta Y_{frame}$ (n)

(2) An interline luminance change amount: $\Delta Y_{line}$(n)

(3) An interframe motion vector: $MV_{frame}$ (n)

Moreover, the correction parameter calculation unit 202 inputs the following data described with reference to FIGS. 9A and 9B, in other words:

(1) the input/output image characteristic amount change rate data corresponding to the interframe luminance change amount;

(2) the input/output image characteristic amount change rate data corresponding to the interline luminance change amount; and (3) the input/output image characteristic amount change rate data corresponding to the interframe motion vector, from the storage unit (database) 150, and inputs the database storage data.

The correction parameter calculation unit 202 calculates a correction parameter 250 for reducing flicker of the image to be corrected 50, using the input data, and outputs the calculated correction parameter 250 to the image correction unit 203.

As described with reference to FIGS. 11A, 11B, 11C, 12B, and 12C, the correction parameter calculation unit 202 calculates FIG. 11C the correction parameters illustrated in FIGS. 11A, 11B, and 11C on the basis of the input data:

FIG. 11A the storage data in the storage unit (database) 150; and

FIG. 11B the characteristic amounts acquired from the image to be corrected 50 by the image characteristic amount calculation unit 201 illustrated in FIGS. 11A, 11B, and 11C.

The correction parameter calculation unit 202 calculates the following image correction parameters illustrated in FIG. 11C, in other words:

(C1) the temporal direction smoothing coefficient (Ft);

(C2) the spatial direction smoothing coefficient (Fs); and (C3) the smoothing processing gain value (G).

The above three types of image correction parameters calculated by the correction parameter calculation unit 202 are input to the image correction unit 203 of the online processing unit 200 illustrated in FIG. 10.

(Steps S205 and S206)

Next, in step S205, the online processing unit 200 executes the image correction processing to which the correction parameters calculated in step S204 have been applied, for the image to be corrected input in step S201, and outputs the corrected image to the display device in step S206.

This processing is the processing executed by the image correction unit 203 of the online processing unit 200 illustrated in FIG. 10.

The image correction unit 203 executes the image correction processing for the image to be corrected 50, applying the following correction parameters 250 input from the correction parameter calculation unit 202.

(C1) The temporal direction smoothing coefficient (Ft)

(C2) The spatial direction smoothing coefficient (Fs)

(C3) The smoothing processing gain value (G)

The corrected image to which the above correction parameters have been applied and corrected is output to the display device 110 and displayed.

(Step S207)

Next, in step S207, the online processing unit 200 determines whether the processing for all the images to be corrected has been completed.

In the case where there is an unprocessed image, the processing of step S201 and the following steps is executed for the unprocessed image.

In a case where it is determined that the processing for all the images to be corrected has been completed, the processing is terminated.

Note that the correction parameters (C1) to (C3) applied in the image correction processing in step S205 are the correction parameters that produce the flicker reduction effect, and are the correction parameters that reflect the characteristics of the input image and the display device output characteristics.

Therefore, optimum flicker reduction processing according to characteristics of an image and characteristics of a display device becomes possible by the image correction to which the correction parameters are applied.

5-3. Sequence of Processing Example 2 Executed by Online Processing Unit

Next, the sequence of the processing example 2 executed by the online processing unit 200 will be described with reference to the flowchart illustrated in FIGS. 15 and 16.

As described with reference to FIGS. 4 and 10, and the like, the online processing unit 200 illustrated in FIG. 4 inputs the image to be corrected data 50, executes the image correction processing using the data stored in the storage unit (database) 150, and outputs the corrected image to the display device 110 to display the corrected image.

Note that the image correction processing in the online processing unit 200 is correction processing executed for the purpose of reducing flicker.

The processing example 2 illustrated in FIGS. 15 and 16 is processing that takes into consideration of the battery remaining amount of the liquid crystal display apparatus that executes the correction processing and displays an image.

For example, in the case of a liquid crystal display apparatus that drives a battery, such as a smart phone, a tablet terminal, or a portable PC, there is a demand to suppress the battery consumption as low as possible.

The processing example 2 to be described below is processing in response to such a demand, and is a processing example of confirming the battery remaining amount of the liquid crystal display apparatus, and cancelling or selecting the correction processing according to the remaining amount.

Note that the processing according to the flowchart illustrated in FIGS. 15 and 16 is not illustrated in FIGS. 4 and 10, for example. However, the processing can be executed under control of the control unit (data processing unit) configured by a CPU and the like having a program execution function according to the program stored in the storage unit of the liquid crystal display apparatus.

Hereinafter, the processing of each step of the flowchart illustrated in FIGS. 15 and 16 will be sequentially described.

(Step S301)

First, in step S301, the online processing unit 200 inputs the image to be corrected.

(Steps S302 and S303)

Next, in step S302, the online processing unit 200 confirms the battery remaining amount of the liquid crystal display apparatus.

Further, in step S303, the online processing unit 200 determines whether the battery remaining amount is a predefined threshold value or more.

For example, the threshold value is a predefined value such as the battery remaining amount=25%.

(Steps S304 and S305)

In step S303, in the case where the battery remaining amount is determined to be the predefined threshold value or more, execution of the image correction processing is determined in step S304, and the processing in step S311 and subsequent steps is executed.

On the other hand, in step S303, in the case where the battery remaining amount is determined to be less than the predefined threshold value, cancellation of the image correction processing is determined in step S305, and the processing is terminated.

(Step S311)

In step S303, in the case where the battery remaining amount is determined to be the predefined threshold value or more, execution of the image correction processing is determined in step S304, and the processing in step S311 and subsequent steps is executed.

In step S311, the online processing unit 200 extracts the characteristic amounts of the image to be corrected.

This processing is the processing executed by the image characteristic amount calculation unit 201 of the online processing unit 200 illustrated in FIG. 10.

The image characteristic amount calculation unit 201 acquires the following image characteristic amounts from the image to be corrected W50.

(1) An interframe luminance change amount: $\Delta Y_{frame}$ (n)

(2) An interline luminance change amount: $\Delta Y_{line}$(n)

(3) An interframe motion vector: $MV_{frame}$ (n)

"(1) The interframe luminance change amount: $\Delta Y_{frame}$ (n)" is a difference in image frame average luminance between two consecutive image frames.

"(2) The interline luminance change amount: $\Delta Y_{line}$(n)" is a difference in pixel line average luminance between adjacent pixel lines in one image frame.

Note that the interline luminance change amount is calculated for each of a horizontal line and a vertical line.

"(3) The interframe motion vector: $MV_{frame(in)}$ (n)" is a motion vector indicating a motion amount between frames calculated from two consecutive image frames.

The image characteristic amount calculation unit 201 calculates these three types of image characteristic amounts, in other words, image characteristic amounts 210 illustrated in FIG. 10, and inputs the calculated image characteristic amounts 210 to the correction parameter calculation unit 202, for example.

(Step S312)

Next, in step S312, the online processing unit 200 selects one or more processing determined to have a high flicker reduction effect from the following processing on the basis of the image characteristic amounts extracted in step S311.

(a) Interframe luminance difference reduction processing (b) Interline luminance difference reduction processing (c) Luminance difference reduction processing according to a motion vector For example, in step S311, the following characteristic amounts extracted from the image to be corrected, in other words:

(1) the interframe luminance change amount: $\Delta Y_{frame}$(n);

(2) the interline luminance change amount: $\Delta Y_{line}$ (n); and (3) the interframe motion vector: $MV_{frame}$ (n)

and the predefined threshold values Th1 to Th3 are compared. When the above characteristic amounts are equal to or larger than the threshold values, it is determined that there is the flicker reduction effect by the processing (a) to (c).

Specifically, for example, the following determination processing is performed.

(Determination Expression 1) The interframe luminance change amount: $\Delta Y_{frame}$ (n)≥Th1

In the case where (Determination Expression 1) is satisfied, it is determined that there is the flicker reduction effect by (a) the interframe luminance difference reduction processing.

Furthermore, in the case where (Determination Expression 2) the interline luminance change amount: $\Delta Y_{line}$ (n)≥Th2 is satisfied, it is determined that there is the flicker reduction effect by (b) the interline luminance difference reduction processing.

Furthermore, in the case where (Determination Expression 3) the interframe motion vector: $MV_{frame}$(n)≥Th3 is satisfied, it is determined that there is the flicker reduction effect by (c) the luminance difference reduction processing according to a motion vector.

Note that these determination processes can be performed on a pixel basis of the image to be corrected or on a pixel region basis configured by a plurality of pixels.

As described above, in step S312, the online processing unit 200 selects one or more processing determined to have a high flicker reduction effect from the following processing on the basis of the image characteristic amounts extracted in step S311.

(a) Interframe luminance difference reduction processing (b) Interline luminance difference reduction processing (c) Luminance difference reduction processing according to a motion vector (Step S313)

Next, in step S313, the online processing unit 200 determines whether there is a sufficient battery remaining amount to execute the processing selected from below as the processing having the flicker reduction effect in step S312, in other words:

(a) the interframe luminance difference reduction processing;

(b) the interline luminance difference reduction processing; and (c) the luminance difference reduction processing according to a motion vector.

Note that the sufficient battery remaining amount to execute the selection processing is a predefined threshold remaining amount.

The threshold remaining amount may be set differently depending on the number of processes selected as the processing having the flicker reduction effect in step S312.

For example, in the case where the threshold value of a case where all the processing (a) to (c) are selected as the processing having the flicker reduction effect in step S312 is Tha, the threshold value of a case where two of the processing (a) to (c) are selected is Thb, and the threshold value of a case where one processing is selected is Thc, the threshold values can be set to satisfy the following relationship.

$$Tha > Thb > Thc$$

In step S313, when the online processing unit 200 determines that there is the sufficient battery remaining amount for executing all the processing selected as the processing having the flicker reduction effect in step S312, the processing proceeds to step S315.

On the other hand, when the online processing unit 200 determines that there is no sufficient battery remaining amount for executing all the selected processing, the processing proceeds to step S314.

(Step S314)

In step S314, when the online processing unit 200 determines that there is no sufficient battery remaining amount for executing all the selected processing in step S312, the processing proceeds to step S314.

In step S314, the online processing unit 200 executes processing of cancelling the image correction processing or processing of further narrowing down the selected processing in step S312. This narrowing down is executed as narrowing down processing that leaves the processing having a higher flicker reduction effect.

In step S314, in the case where cancellation of the image correction processing is determined, the processing is terminated without performing the image correction processing. In this case, an image without correction is output to the display device.

On the other hand, in the case where the selection processing of further narrowing down the selection processing in step S312 is executed, the selection processing by narrowing down is executed in step S315 and subsequent steps.

(Step S315)

Next, in step S315, the online processing unit 200 calculates the correction parameter to be applied to execute the processing selected from below as the processing having the flicker reduction effect in step S312, or the processing selected by narrowing down in step S314, in other words:

(a) the interframe luminance difference reduction processing;

(b) the interline luminance difference reduction processing; and (c) the luminance difference reduction processing according to a motion vector.

This processing is the processing executed by the correction parameter calculation unit 202 of the online processing unit 200 illustrated in FIG. 10.

Note that the calculation of the correction parameter is executed on a region basis, the region being targeted for flicker reduction effect existence determination processing in step S312. In other words, the processing is executed on a pixel basis of the image to be corrected or on a pixel region basis configured by a plurality of pixels.

The correction parameter calculation unit 202 inputs the following image characteristic amounts of the image to be corrected 50 from the image characteristic amount calculation unit 201.

(1) An interframe luminance change amount: $\Delta Y_{frame}$ (n)

(2) An interline luminance change amount: $\Delta Y_{line}$(n)

(3) An interframe motion vector: $MV_{frame}$ (n)

Moreover, the correction parameter calculation unit 202 inputs the following data described with reference to FIGS. 9A and 9B, in other words:

(1) the input/output image characteristic amount change rate data corresponding to the interframe luminance change amount;

(2) the input/output image characteristic amount change rate data corresponding to the interline luminance change amount; and (3) the input/output image characteristic amount change rate data corresponding to the interframe motion vector, from the storage unit (database) 150, and inputs the database storage data.

The correction parameter calculation unit 202 calculates a correction parameter 250 for reducing flicker of the image to be corrected 50, using the input data, and outputs the calculated correction parameter 250 to the image correction unit 203.

As described with reference to FIGS. 11A, 11B, 11C, 12B, and 12C, the correction parameter calculation unit 202 calculates FIG. 11C the correction parameters illustrated in FIGS. 11A, 11B, and 11C on the basis of the input data:

FIG. 11A the storage data in the storage unit (database) 150; and

FIG. 11B the characteristic amounts acquired from the image to be corrected 50 by the image characteristic amount calculation unit 201 illustrated in FIGS. 11A, 11B, and 11C.

The correction parameter calculation unit 202 calculates the following image correction parameters illustrated in FIG. 11C, in other words:

(C1) the temporal direction smoothing coefficient (Ft);

(C2) the spatial direction smoothing coefficient (Fs); and (C3) the smoothing processing gain value (G).

The above three types of image correction parameters calculated by the correction parameter calculation unit 202 are input to the image correction unit 203 of the online processing unit 200 illustrated in FIG. 10.

(Steps S316 and S317)

Next, in step S316, the online processing unit 200 executes the image correction processing to which the correction parameters calculated in step S315 have been applied, for the image to be corrected input in step S301, and outputs the corrected image to the display device in step S317.

This processing is the processing executed by the image correction unit 203 of the online processing unit 200 illustrated in FIG. 10.

The image correction unit 203 executes the image correction processing for the image to be corrected 50, applying the following correction parameters 250 input from the correction parameter calculation unit 202.

(C1) The temporal direction smoothing coefficient (Ft)

(C2) The spatial direction smoothing coefficient (Fs)

(C3) The smoothing processing gain value (G)

The corrected image to which the above correction parameters have been applied and corrected is output to the display device 110 and displayed.

(Step S318)

Next, in step S318, the online processing unit 200 determines whether the processing for all the images to be corrected has been completed.

In the case where there is an unprocessed image, the processing of step S301 and the following steps is executed for the unprocessed image.

In a case where it is determined that the processing for all the images to be corrected has been completed, the processing is terminated.

Note that the correction parameters (C1) to (C3) applied in the image correction processing in step S316 are the correction parameters that produce the flicker reduction effect, and are the correction parameters that reflect the characteristics of the input image and the display device output characteristics.

Therefore, optimum flicker reduction processing according to characteristics of an image and characteristics of a display device becomes possible by the image correction to which the correction parameters are applied.

6. Hardware Configuration Example of Liquid Crystal Display Apparatus

Next, a hardware configuration example of the liquid crystal display apparatus will be described with reference to FIG. 17.

Figure 17:
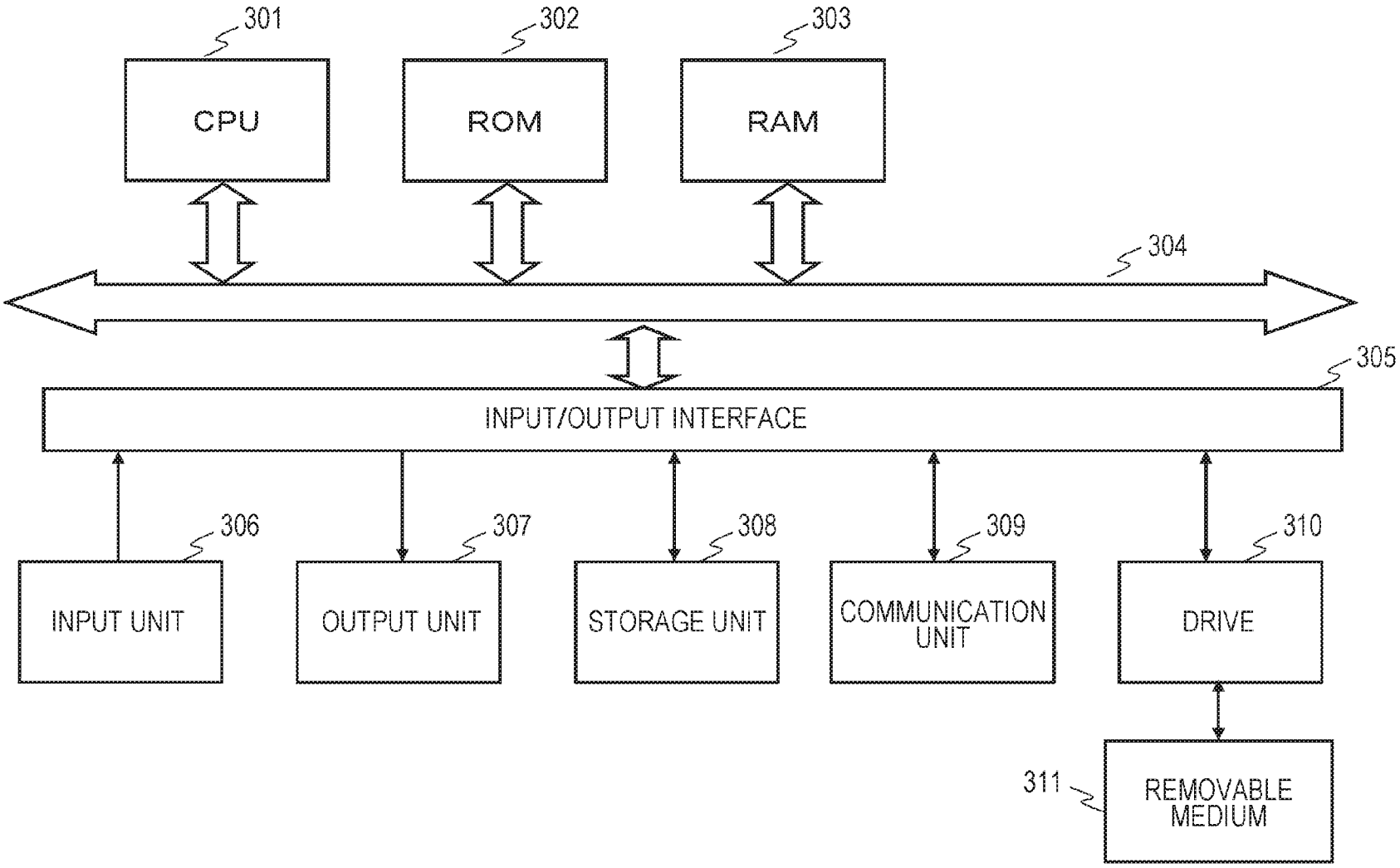
FIG. 17 is a diagram for describing a hardware configuration example of the liquid crystal display apparatus of the present disclosure.

FIG. 17 is a diagram illustrating a hardware configuration example of the liquid crystal display apparatus that executes the processing of the present disclosure.

A central processing unit (CPU) 301 functions as a control unit and a data processing unit that execute various types of processing according to a program stored in a read only memory (ROM) 302 or a storage unit 308. For example, the CPU 301 executes processing according to the sequence described in the above embodiment. A random access memory (RAM) 303 stores the program executed by the CPU 301, data, and the like. These CPU 301, ROM 302, and RAM 303 are mutually connected by a bus 304.

The CPU 301 is connected to an input/output interface 305 via the bus 304. An input unit 306 including various switches, a keyboard, a mouse, a microphone, and the like, through which the user can input commands, and an output unit 307 that executes data outputs to an display unit, a speaker, and the like are connected to the input/output interface 305. The CPU 301 executes various types of processing in accordance with a command input from the input unit 306, and outputs a processing result to the output unit 307, for example.

The storage unit 308 connected to the input/output interface 305 includes, for example, a hard disk and the like, and stores the program executed by the CPU 301 and various data. A communication unit 309 functions as a transmission/reception unit for Wi-Fi communication, Bluetooth (BT) communication, or another data communication via a network such as the Internet or a local area network, and communicates with an external device.

A drive 310 connected to the input/output interface 305 drives a removable medium 311 such as a magnetic disk, an optical disk, a magneto-optical disk, or a semiconductor memory such as a memory card, and executes data recording or reading.

7. Summary of Configuration of Present Disclosure

The embodiments of the present disclosure have been described in detail with reference to the specific embodiments. However, it is obvious that those skilled in the art can make modifications and substitutions of the embodiments without departing from the gist of the present disclosure. In other words, the present invention has been disclosed in the form of exemplification, and should not be restrictively interpreted. To judge the gist of the present disclosure, the section of claims should be taken into consideration.

Note that the technology disclosed in the present specification can have the following configurations.

(1) A liquid crystal display apparatus including:

a storage unit configured to store a characteristic amount change rate that is a change rate between a characteristic amount of a sample image and a characteristic amount of an output sample image with respect to a liquid crystal display device;

a characteristic amount extraction unit configured to extract a characteristic amount of an image to be corrected;

a correction parameter calculation unit configured to calculate a correction parameter for reducing flicker on the basis of the characteristic amount of the image to be corrected and the characteristic amount change rate; and an image correction unit configured to execute, for the image to be corrected, correction processing to which the correction parameter has been applied.

(2) The liquid crystal display apparatus according to (1), in which the storage unit includes the characteristic amount change rate between input/output sample images corresponding to a temporal change amount of at least one of characteristic amounts (1) to (3):

(1) an interframe luminance change amount;

(2) an interline luminance conversion amount; and (3) an interframe motion vector, the characteristic amount extraction unit extracts at least one of the characteristic amounts (1) to (3) from the image to be corrected, and the correction parameter calculation unit calculates the correction parameter for reducing flicker on the basis of the one of the characteristic amounts (1) to (3) of the image to be corrected and the characteristic amount change rate of one of the characteristic amounts (1) to (3).

(3) The liquid crystal display apparatus according to (1) or (2), in which the correction parameter calculation unit calculates at least one of correction parameters (C1) to (C3):

(C1) a temporal direction smoothing coefficient;

(C2) a spatial direction smoothing coefficient; and (C3) a smoothing processing gain value, as the correction parameter for reducing flicker.

(4) The liquid crystal display apparatus according to any one of (1) to (3), in which the correction parameter calculation unit calculates a temporal direction smoothing coefficient that is the correction parameter for reducing flicker on the basis of an interframe luminance change amount that is the characteristic amount of the image to be corrected.

(5) The liquid crystal display apparatus according to any one of (1) to (4), in which the correction parameter calculation unit calculates a spatial direction smoothing coefficient that is the correction parameter for reducing flicker on the basis of an interline luminance change amount that is the characteristic amount of the image to be corrected.

(6) The liquid crystal display apparatus according to any one of (1) to (5), in which the correction parameter calculation unit calculates a smoothing processing gain value that is the correction parameter for reducing flicker on the basis of an interframe motion vector that is the characteristic amount of the image to be corrected.

(7) The liquid crystal display apparatus according to any one of (1) to (6), in which the characteristic amount extraction unit extracts the characteristic amount of the image to be corrected on a pixel basis or on a pixel region basis, and the correction parameter calculation unit calculates the correction parameter for reducing flicker on a pixel basis of the image to be corrected or on a pixel region basis.

(8) The liquid crystal display apparatus according to any one of (1) to (7), in which the image correction unit selects or cancels the correction processing to be executed for the image to be corrected according to a battery remaining amount of the liquid crystal display apparatus.

(9) The liquid crystal display apparatus according to any one of (1) to (8), further including:

an offline processing unit configured to calculate the characteristic amount change rate that is a change rate between a characteristic amount of a sample image and a characteristic amount of an output sample image with respect to a liquid crystal display device.

(10) The liquid crystal display apparatus according to (9), in which the offline processing unit calculates the characteristic amount change rate between the input/output sample images corresponding to a temporal change amount of at least each of characteristic amounts (1) to (3):

(1) an interframe luminance change amount;

(2) an interline luminance conversion amount; and (3) an interframe motion vector.

(11) The liquid crystal display apparatus according to (9) or (10), in which the offline processing unit acquires information for acquiring the characteristic amount of the output sample image from a panel drive unit of the liquid crystal display device.

(12) A liquid crystal display apparatus including:

an offline processing unit configured to calculate a characteristic amount change rate that is a change rate between a characteristic amount of a sample image and a characteristic amount of an output sample image with respect to a liquid crystal display device;

a storage unit configured to store the characteristic amount change rate calculated by the offline processing unit; and an online processing unit configured to apply the characteristic amount change rate stored in the storage unit and execute correction processing of an image to be corrected, in which the online processing unit includes a characteristic amount extraction unit configured to extract a characteristic amount of the image to be corrected, a correction parameter calculation unit configured to calculate a correction parameter for reducing flicker on the basis of the characteristic amount of the image to be corrected and the characteristic amount change rate, and an image correction unit configured to execute, for the image to be corrected, correction processing to which the correction parameter has been applied.

(13) The liquid crystal display apparatus according to (12), in which the storage unit includes the characteristic amount change rate between input/output sample images corresponding to a temporal change amount of at least one of characteristic amounts (1) to (3):

(1) an interframe luminance change amount;

(2) an interline luminance conversion amount; and (3) an interframe motion vector, the characteristic amount extraction unit of the online processing unit extracts at least one of the characteristic amounts (1) to (3) from the image to be corrected, and the correction parameter calculation unit calculates the correction parameter for reducing flicker on the basis of the one of the characteristic amounts (1) to (3) of the image to be corrected and the characteristic amount change rate of one of the characteristic amounts (1) to (3).

(14) The liquid crystal display apparatus according to (12) or (13), in which the correction parameter calculation unit of the online processing unit calculates at least one of correction parameters (C1) to (C3):

(C1) a temporal direction smoothing coefficient;

(C2) a spatial direction smoothing coefficient; and (C3) a smoothing processing gain value, as the correction parameter for reducing flicker.

(15) A liquid crystal display control method executed in a liquid crystal display apparatus, the liquid display apparatus including a storage unit configured to store a characteristic amount change rate that is a change rate between a characteristic amount of a sample image and a characteristic amount of an output sample image with respect to a liquid crystal display device, the liquid crystal display control method including:

by a characteristic amount extraction unit, extracting a characteristic amount of an image to be corrected;

by a correction parameter calculation unit, calculating a correction parameter for reducing flicker on the basis of the characteristic amount of the image to be corrected and the characteristic amount change rate; and by an image correction unit, executing, for the image to be corrected, correction processing to which the correction parameter has been applied and outputting the image to be corrected on a display unit.

(16) A liquid crystal display control method executed in a liquid crystal display apparatus, the liquid crystal display control method including:

by an offline processing unit, executing an offline processing step of calculating a characteristic amount change rate that is a change rate between a characteristic amount of a sample image and a characteristic amount of an output sample image with respect to a liquid crystal display device, and storing the characteristic amount change rate in a storage unit; and by an online processing unit, extracting a characteristic amount of an image to be corrected, calculating a correction parameter for reducing flicker on the basis of the characteristic amount of the image to be corrected and the characteristic amount change rate stored in the storage unit, and executing, for the image to be corrected, correction processing to which the correction parameter has been applied, and displaying the image to be corrected on a display unit.

(17) A program for executing liquid crystal display control processing in a liquid crystal display apparatus, the liquid display apparatus including a storage unit configured to store a characteristic amount change rate that is a change rate between a characteristic amount of a sample image and a characteristic amount of an output sample image with respect to a liquid crystal display device, the program generating a corrected image for a display unit output by executing:

characteristic amount extraction processing of an image to be corrected in a characteristic amount extraction unit;

processing of calculating a correction parameter for reducing flicker based on a characteristic amount of the image to be corrected and the characteristic amount change rate in a correction parameter calculation unit; and correction processing to which the correction parameter has been applied for the image to be corrected in an image correction unit.

(18) A program for executing liquid crystal display control processing in a liquid crystal display apparatus, the program generating a corrected image for a display unit output by causing:

an offline processing unit to execute offline processing of calculating a characteristic amount change rate that is a change rate between a characteristic amount of a sample image and a characteristic amount of an output sample image with respect to a liquid crystal display device, and storing the characteristic amount change rate in a storage unit; and an online processing unit to execute characteristic amount extraction processing of an image to be corrected, processing of calculating a correction parameter for reducing flicker based on the characteristic amount of the image to be corrected and the characteristic amount change rate stored in the storage unit, and correction processing to which the correction parameter has been applied, for the image to be corrected.

Further, the series of processing described in the specification can be executed by hardware, software, or a combined configuration of the hardware and software. In the case of executing the processing by software, a program, which records the processing sequence, can be installed and executed in a memory in a computer incorporated in dedicated hardware, or the program can be installed and executed in a general-purpose computer capable of executing various types of processing. For example, the program can be recorded in a recording medium beforehand. Other than the installation from the recording medium to the computer, the program can be received via a network such as a local area network (LAN) or the Internet and can be installed to a recording medium such as a built-in hard disk.

Note that the various types of processing described in the specification may be executed not only in chronological order as described but also in parallel or individually depending on the processing capability of the device executing the process or as required. Furthermore, the system in the present specification is a logical aggregate configuration of a plurality of devices, and is not limited to devices having respective configurations within the same housing.

INDUSTRIAL APPLICABILITY

As described above, the configuration of one embodiment of the present disclosure, the effective image correction processing for reducing flicker according to the characteristics of the images is executed, and the flicker of the image to be displayed on the liquid crystal display apparatus can be effectively reduced.

Specifically, characteristic amount change rate data which is the change rate between the characteristic amount of the sample image and the characteristic amount of the sample image output to the liquid crystal display device is acquired in advance and stored in the storage unit. The correction parameter for reducing flicker is calculated on the basis of the characteristic amount of the image to be corrected and the characteristic amount change rate data of the sample images stored in the storage unit. The correction processing to which the calculated correction parameter has been applied is executed for the image to be corrected to generate a display image. As the characteristic amount, for example, the interframe luminance change amount, the interline luminance conversion amount, or the interframe motion vector is used.

With the configuration, the effective image correction processing for reducing flicker according to the characteristics of images is executed, and the flicker of the image to be displayed on the liquid crystal display apparatus can be effectively reduced.

REFERENCE SIGNS LIST

10 Liquid crystal display apparatus
20 Sample image
50 Image to be corrected
100 Online processing unit
101 Image characteristic amount calculation unit
102 Image temporal change amount calculation unit
103 Input/output image characteristic amount change rate calculation unit
104 Drive voltage temporal change amount (light emission level temporal change amount) acquisition unit
110 Display device
111 Panel drive unit
112 Liquid crystal panel
150 Storage unit (database)
200 Online processing unit
201 Image characteristic amount calculation unit
202 Correction parameter calculation unit
203 Image correction unit
301 CPU
302 ROM
303 RAM
304 Bus
305 Input/output interface
306 Input unit
307 Output unit
308 Storage unit
309 Communication unit
310 Drive
311 Removable medium

The invention claimed is:

1. A liquid crystal display apparatus, comprising:

a memory configured to store a characteristic amount change rate that is a change rate between a characteristic amount of a sample image and a characteristic amount of an output sample image with respect to a liquid crystal display device; and a first processor configured to:

extract a characteristic amount of an image to be corrected;

calculate a correction parameter to reduce flicker, wherein the correction parameter is calculated based on the characteristic amount of the image and the characteristic amount change rate; and execute, for the image, a correction process to which the correction parameter is applied.

2. The liquid crystal display apparatus according to claim 1, wherein the characteristic amount change rate is between input/output sample images corresponding to a temporal change amount of at least one of characteristic amounts (1) to (3):

(1) an interframe luminance change amount;

(2) an interline luminance conversion amount; and (3) an interframe motion vector, and the first processor is further configured to:

extract the at least one of the characteristic amounts (1) to (3) from the image; and calculate the correction parameter based on the at least one of the characteristic amounts (1) to (3) of the image and the characteristic amount change rate of one of the characteristic amounts (1) to (3).

3. The liquid crystal display apparatus according to claim 1, wherein the first processor is further configured to calculate at least one of correction parameters (C1) to (C3):

(C1) a temporal direction smoothing coefficient;

(C2) a spatial direction smoothing coefficient; and (C3) a smoothing processing gain value, as the correction parameter to reduce the flicker.

4. The liquid crystal display apparatus according to claim 1, wherein the first processor is further configured to calculate a temporal direction smoothing coefficient based on an interframe luminance change amount that is the characteristic amount of the image, and the temporal direction smoothing coefficient is the correction parameter.

5. The liquid crystal display apparatus according to claim 1, wherein the first processor is further configured to calculate a spatial direction smoothing coefficient based on an interline luminance change amount that is the characteristic amount of the image, and the spatial direction smoothing coefficient is the correction parameter.

6. The liquid crystal display apparatus according to claim 1, wherein the first processor is further configured to calculate a smoothing processing gain value based on an interframe motion vector that is the characteristic amount of the image, and the smoothing processing gain value is the correction parameter.

7. The liquid crystal display apparatus according to claim 1, wherein the first processor is further configured to:

extract the characteristic amount of the image on one of a pixel basis or a pixel region basis; and calculate the correction parameter based on the one of the pixel basis of the image or the pixel region basis.

8. The liquid crystal display apparatus according to claim 1, wherein the first processor is further configured to one of select or cancel the correction process for the image based on a battery remaining amount of the liquid crystal display apparatus.

9. The liquid crystal display apparatus according to claim 1, further comprising a second processor configured to calculate the characteristic amount change rate that is the change rate between the characteristic amount of the sample image and the characteristic amount of the output sample image with respect to the liquid crystal display device.

10. The liquid crystal display apparatus according to claim 9, wherein the second processor is further configured to calculate the characteristic amount change rate between input/output sample images corresponding to a temporal change amount of at least each of characteristic amounts (1) to (3):

(1) an interframe luminance change amount;

(2) an interline luminance conversion amount; and (3) an interframe motion vector.

11. The liquid crystal display apparatus according to claim 9, wherein the second processor is further configured to acquire the characteristic amount of the output sample image from a panel driver of the liquid crystal display device.

12. A liquid crystal display apparatus, comprising:

a first processor configured to calculate a characteristic amount change rate that is a change rate between a characteristic amount of a sample image and a characteristic amount of an output sample image with respect to a liquid crystal display device;

a memory configured to store the characteristic amount change rate; and a second processor configured to:

apply the characteristic amount change rate stored in the memory;

execute a correction process of an image to be corrected;

extract a characteristic amount of the image;

calculate a correction parameter to reduce flicker, wherein the correction parameter is calculated based on the characteristic amount of the image and the characteristic amount change rate; and execute, for the image, the correction process to which the correction parameter is applied.

13. The liquid crystal display apparatus according to claim 12, wherein the characteristic amount change rate is between input/output sample images corresponding to a temporal change amount of at least one of characteristic amounts (1) to (3);

(1) an interframe luminance change amount;

(2) an interline luminance conversion amount; and (3) an interframe motion vector, and the second processor is further configured to:

extract the at least one of the characteristic amounts (1) to (3) from the image; and calculate the correction parameter based on the at least one of the characteristic amounts (1) to (3) of the image and the characteristic amount change rate of one of the characteristic amounts (1) to (3).

14. The liquid crystal display apparatus according to claim 12, wherein the second processor is further configured to calculate at least one of correction parameters (C1) to (C3):

(C1) a temporal direction smoothing coefficient;

(C2) a spatial direction smoothing coefficient; and (C3) a smoothing processing gain value, as the correction parameter to reduce the flicker.

15. A liquid crystal display control method, comprising: in a liquid crystal display apparatus that includes a memory, storing, in the memory, a characteristic amount change rate that is a change rate between a characteristic amount of a sample image and a characteristic amount of an output sample image with respect to a liquid crystal display device;

extracting a characteristic amount of an image to be corrected;

calculating a correction parameter for reducing flicker, wherein the correction parameter is calculated based on the characteristic amount of the image and the characteristic amount change rate;

executing, for the image, correction processing to which the correction parameter is applied; and outputting the image on a display screen.

16. A liquid crystal display control method comprising:

in a liquid crystal display apparatus, calculating, by a first processor of the liquid crystal display apparatus, a characteristic amount change rate that is a change rate between a characteristic amount of a sample image and a characteristic amount of an output sample image with respect to a liquid crystal display device;

storing, in a memory of the liquid crystal display apparatus, the characteristic amount change rate;

extracting, by a second processor of the liquid crystal display apparatus, a characteristic amount of an image;

calculating, by the second processor, a correction parameter for reducing flicker, wherein the correction parameter is calculated based on the characteristic amount of the image and the characteristic amount change rate;

executing, by the second processor, correction processing for the image, wherein the correction parameter is applied to the correction processing; and controlling, by the second processor, display of the image on a display unit.

17. A non-transitory computer-readable medium having stored thereon, computer-executable instructions which, when executed by a processor, cause a liquid crystal display apparatus to execute operations, the operations comprising:

controlling a memory to store a characteristic amount change rate that is a change rate between a characteristic amount of a sample image and a characteristic amount of an output sample image with respect to a liquid crystal display device;

extracting a characteristic amount of an image to be corrected;

calculating a correction parameter for reducing flicker, wherein the correction parameter is calculated based on the characteristic amount of the image and the characteristic amount change rate; and executing, for the image, correction processing to which the correction parameter is applied.

18. A non-transitory computer-readable medium having stored thereon, computer-executable instructions which, when executed by a processor, cause a liquid crystal display apparatus to execute operations, the operations comprising:

calculating a characteristic amount change rate that is a change rate between a characteristic amount of a sample image and a characteristic amount of an output sample image with respect to a liquid crystal display device;

controlling a memory to store the characteristic amount change rate;

extracting a characteristic amount of an image to be corrected;

calculating a correction parameter for reducing flicker, wherein the correction parameter is calculated based on the characteristic amount of the image and the characteristic amount change rate; and executing, for the image, correction processing to which the correction parameter is applied.

* * * * *